US012637793B2

(12) United States Patent
Katano et al.

(10) Patent No.: US 12,637,793 B2
(45) Date of Patent: May 26, 2026

(54) EDITING APPARATUS

(71) Applicant: BROTHER KOGYO KABUSHIKI KAISHA, Nagoya (JP)

(72) Inventors: Tomotaka Katano, Owariasahi (JP); Daisuke Abe, Nagoya (JP); Yuta Kamihira, Ama (JP); Sayaka Kurihara, Nagoya (JP); Kazuki Shibata, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 19/002,928

(22) Filed: Dec. 27, 2024

(65) Prior Publication Data

US 2025/0122657 A1 Apr. 17, 2025

Related U.S. Application Data

(63) Continuation of application No. 18/190,451, filed on Mar. 27, 2023, now Pat. No. 12,221,730.

(30) Foreign Application Priority Data

Mar. 28, 2022 (JP) ..... 2022-052032

(51) Int. Cl.
*D05B 19/08* (2006.01)
*D05B 19/10* (2006.01)
*D05B 19/12* (2006.01)

(52) U.S. Cl.
CPC ..... *D05B 19/08* (2013.01); *D05B 19/10* (2013.01); *D05B 19/12* (2013.01)

(58) Field of Classification Search
CPC ..... D05B 19/08; D05B 19/10; D05B 19/12
See application file for complete search history.

(56) References Cited

U.S. PATENT DOCUMENTS 5,791,270 A * 8/1998 Mori ..... G05B 19/408 112/102.5
2005/0182508 A1* 8/2005 Niimi ..... D05B 19/08 700/138
2006/0137583 A1* 6/2006 Kato ..... D05B 19/10 112/102.5
2016/0031108 A1* 2/2016 Bailie ..... B26D 5/005 700/134

FOREIGN PATENT DOCUMENTS

CN 201657505 U 11/2010
JP 2005-230256 A 9/2005
JP 2019-168774 A 10/2019

* cited by examiner

*Primary Examiner* — Nathan E Durham
(74) *Attorney, Agent, or Firm* — Oliff PLC

(57) ABSTRACT

An editing apparatus displays an editing screen for editing data for a medium to be processed by processing equipment including a printer, a cutting machine, and a sewing machine on a display. The data includes print data to drive the printer, cutting data to drive the cutting machine, and sewing data to drive the sewing machine. The editing apparatus receives an operation for editing the data with the editing screen or the preview screen displayed on the display, edits the data in accordance with the operation received, and outputs the data edited to the printer, the cutting machine, and the sewing machine.

16 Claims, 13 Drawing Sheets

EDITING APPARATUS

REFERENCE TO RELATED APPLICATIONS

This is a Continuation of U.S. patent application Ser. No. 18/190,451, filed Mar. 27, 2023, which claims priority from Japanese Patent Application No. 2022-052032 filed on Mar. 28, 2022. The entire content of the priority application is incorporated herein by reference.

BACKGROUND ART

A known controller is capable of creating cutting data and embroidery data. The controller creates, based on contour data extracted from a character font, cutting data indicated by a broken line connecting many points on the contour. The cutting machine is driven based on the cutting data to thermally cut cloth for an applique piece. The controller also creates basting data for positioning, stitching-in-place data, and satin-stitching data. The embroidery sewing machine is driven based on the basting data for positioning to baste the applique piece on cloth for arrangement. The embroidery sewing machine is then driven based on the stitching-in-place data to perform stitching in place on the applique piece basted on the cloth. The embroidery sewing machine is then driven based on the satin-stitching data to make satin stitches on the applique piece stitched in place on the cloth.

DESCRIPTION

There is a demand for editing, at a time, cutting data for driving a cutting machine, embroidery data for driving a sewing machine, and print data for driving a printer. The above-described controller is designed to edit cutting data and embroidery data, but not to edit print data.

An object of the disclosure is to provide an editing apparatus able to edit cutting data, embroidery data, and print data at a time.

According to an aspect of the disclosure, a non-transitory storage medium stores an editing program executable by a computer. The program causes the computer to perform operations including displaying an editing screen or a preview screen on a display. The editing screen is for editing data for a medium to be processed by processing equipment. The preview screen is for showing a state of the medium processed in accordance with the data edited. The processing equipment includes a printer, a cutting machine, and a sewing machine. The printer prints a print pattern on the medium. The cutting machine cuts the medium having the print pattern printed. The sewing machine sews an embroidery pattern on the cut medium. The data includes print data to drive the printer, cutting data to drive the cutting machine, and sewing data to drive the sewing machine. The operations include receiving an operation for editing the data with the editing screen or the preview screen displayed on the display, editing the data in accordance with the operation received, and outputting the data edited. Outputting the data edited includes outputting the print data to the printer, outputting the cutting data to the cutting machine, and outputting the embroidery data to the sewing machine.

According to another aspect of the disclosure, an editing apparatus includes a controller and a storage medium storing a program executable by the controller. The controller performs operations including displaying an editing screen or a preview screen on a display. The editing screen is for editing data for a medium to be processed by processing equipment. The preview screen is for showing a state of the medium processed in accordance with the data edited. The processing equipment includes a printer, a cutting machine, and a sewing machine. The printer prints a print pattern on the medium. The cutting machine cuts the medium having the print pattern printed. The sewing machine sews an embroidery pattern on the cut medium. The data includes print data to drive the printer, cutting data to drive the cutting machine, and sewing data to drive the sewing machine. The operations include receiving an operation for editing the data with the editing screen or the preview screen displayed on the display, editing the data in accordance with the operation received, and outputting the data edited. Outputting the data edited includes outputting the print data to the printer, outputting the cutting data to the cutting machine, and outputting the embroidery data to the sewing machine.

According to the aspects of the disclosure, the print data, the cutting data, and the embroidery data can be edited at once and output to the processing equipment (the printer, the cutting machine, and the sewing machine).

Figure 1:
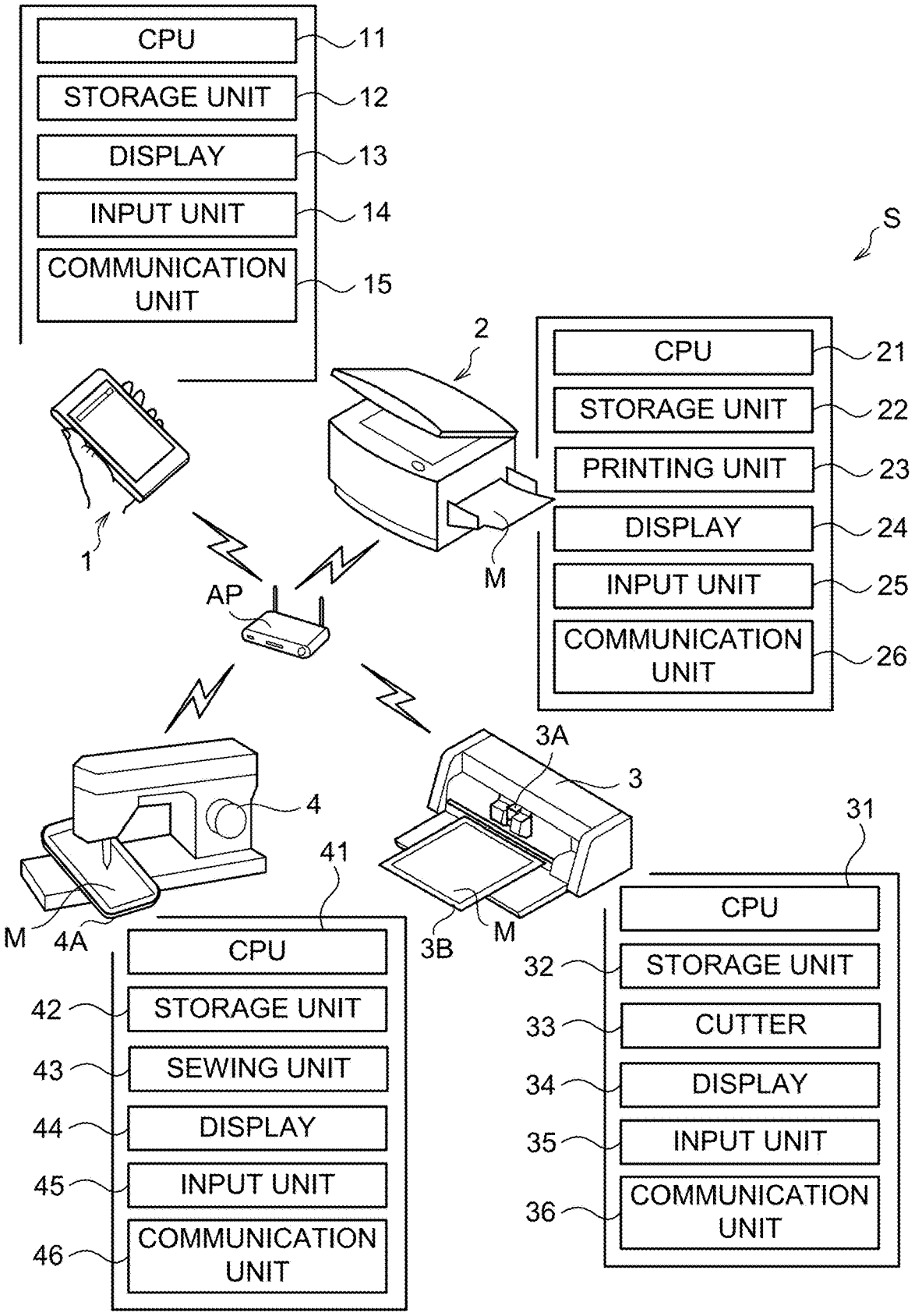
FIG. 1 is a diagram showing an overview of a system S.
Figure 2:
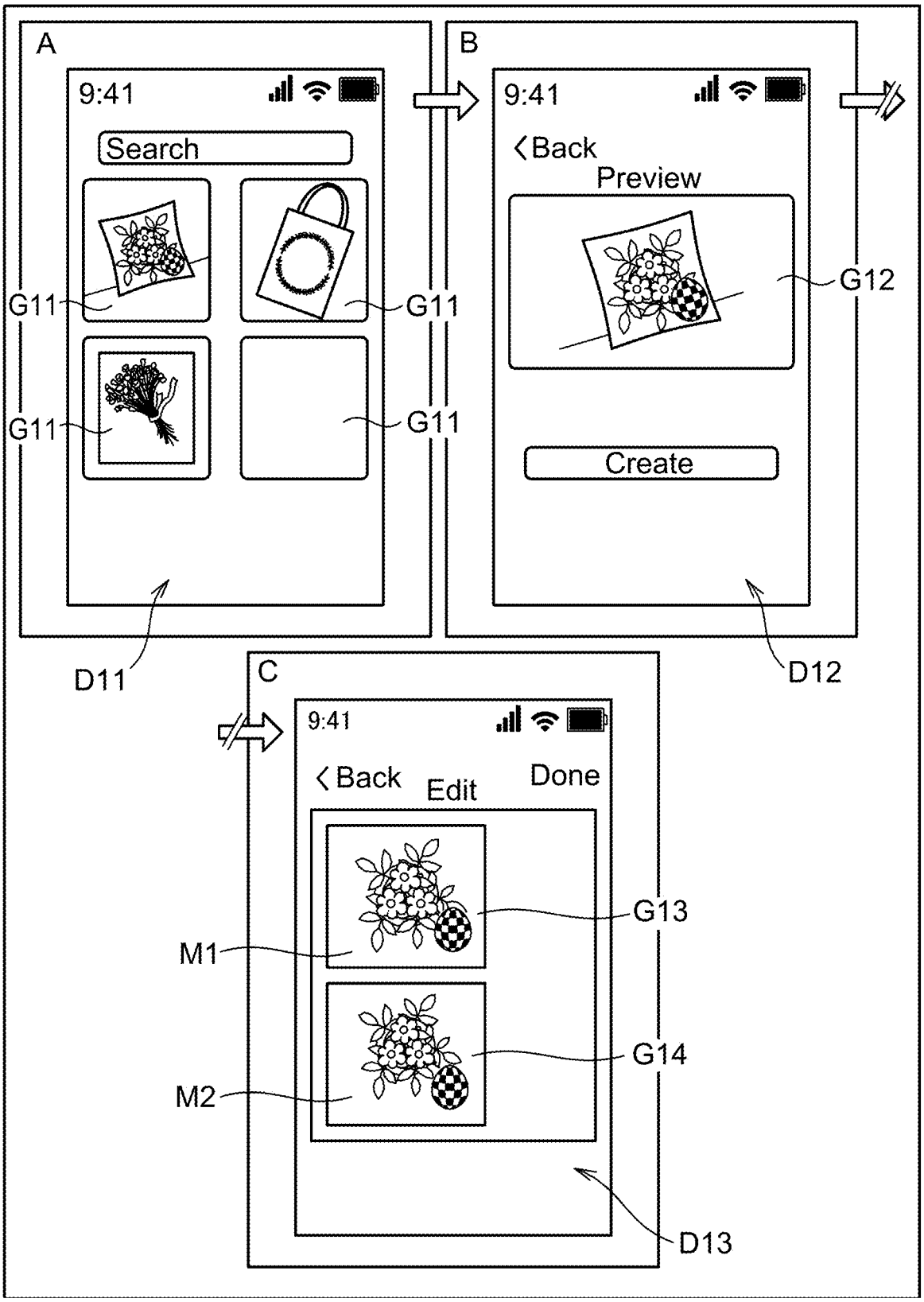
FIG. 2 illustrates a selection screen, a work image screen, and a preview screen.
Figure 3:
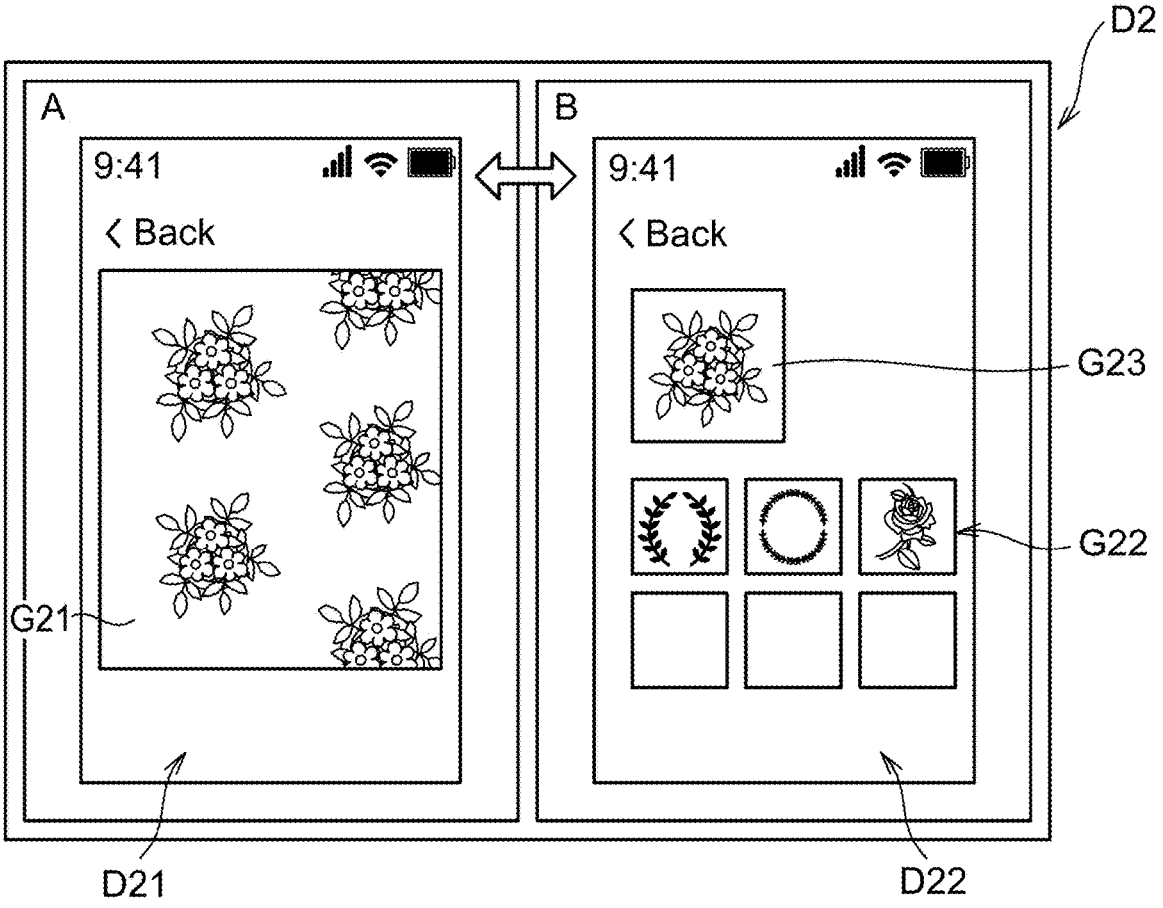
FIG. 3 illustrates a first screen (including a first preview screen and a first editing screen).
Figure 4:
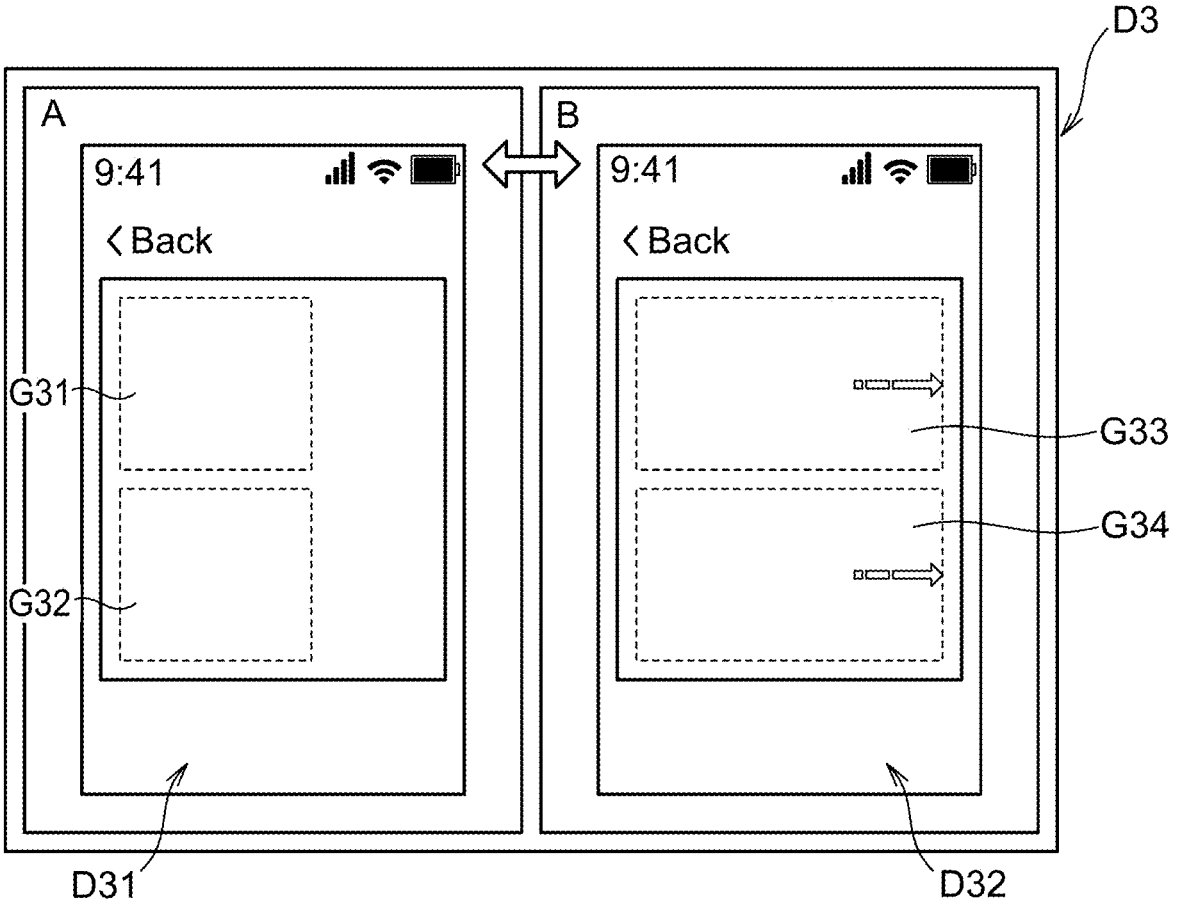
FIG. 4 illustrates a second screen (including a second preview screen and a second editing screen).
Figure 5:
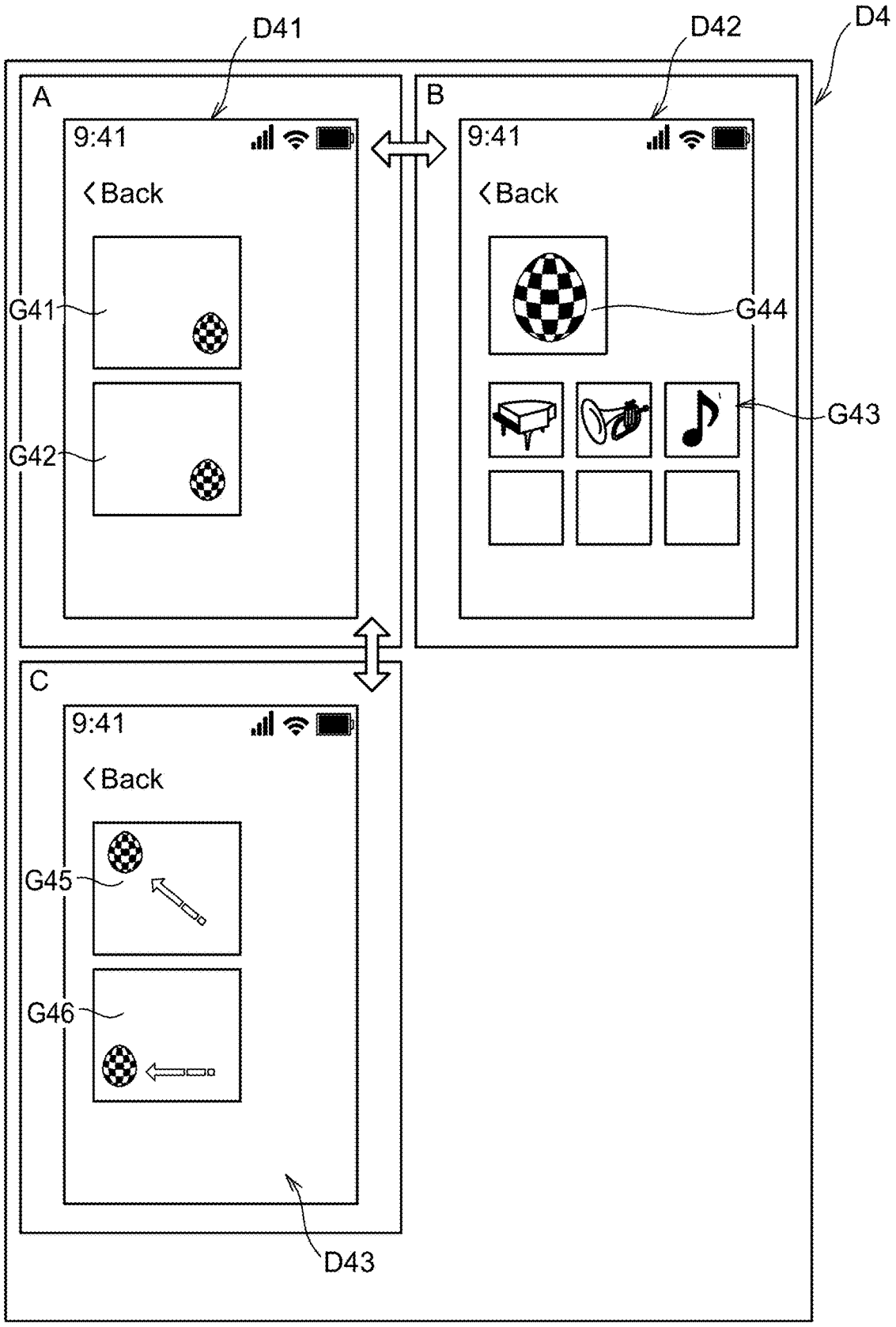
FIG. 5 illustrates a third screen (including a third preview screen and third editing screens).

A system S according to an embodiment is described with reference to the accompanying drawings. The drawings to be referred to are used for describing technical features employable in the disclosure. Configurations of the system, and flowcharts of various processing illustrated in the drawings are not intended to limit the disclosure thereto but are merely examples.

Overview of System S

An overview of the system S will be described with reference to FIG. 1. The system S includes a smartphone 1, a printer 2, a cutting machine 3, and a sewing machine 4. The smartphone 1, the printer 2, the cutting machine 3, and the sewing machine 4 are connected to an access point AP so as to be communicable with each other wirelessly. The smartphone 1, the printer 2, the cutting machine 3, and the sewing machine 4 can communicate with each other via the access point AP.

The printer 2 is driven based on print data to print a print pattern on a medium M. The medium M is, for example, cloth. The printer 2 includes a CPU 21, a storage unit 22, a printing unit 23, a display 24, an input unit 25, and a communication unit 26. The CPU 21 performs overall control of the primer 2. The storage unit 22 stores programs and print data to be executed by the CPU 21. The printing unit 23 has ink nozzles. The printing unit 23 prints a print pattern on the medium M by ejecting ink droplets from the ink nozzles onto the medium M.

The display 24 is an LCD (liquid crystal display). The input unit 25 is a touch screen provided on the display 24. The communication unit 26 is a communication module for communicating with the smartphone 1, the cutting machine 3, and the sewing machine 4 via the access point AP.

The cutting machine 3 is driven based on cutting data to cut the medium M having a print pattern printed by the printer 2 along a cutting line. The cutting machine 3 includes a CPU 31, a storage unit 32, a cutter 33, a display 34, an input unit 35, and a communication unit 36. The CPU 31 performs overall control of the cutting machine 3. The storage unit 32 stores programs and cutting data to be executed by the CPU 31. The cutter 33 includes a conveying mechanism, a first moving mechanism, and a second moving mechanism. The conveying mechanism conveys a holding plate 3B, which holds the medium M on the upper surface, in the sub-scanning direction. The first moving mechanism moves a cartridge 3A in the main scanning direction. The second moving mechanism moves the cartridge 3A in a vertical direction orthogonal to the main scanning direction and the sub-scanning direction. The CPU 31 controls the cutter 33 based on cutting data stored in the storage unit 32 as follows. The CPU 31 controls the second moving mechanism to move the cartridge 3A in the downward direction until the cutting blade of the cartridge 3A comes in contact with the medium M. In this state, the CPU 31 controls the conveying mechanism and the first moving mechanism to move the holding plate 3B and the cartridge 3A. The cutting blade thus moves relative to the medium M in the main scanning direction and the sub-scanning direction and cuts the medium M along cutting lines.

The display 34 is an LCD (liquid crystal display). The input unit 35 is a touch screen provided on the display 34. The communication unit 36 is a communication module for communicating with the smartphone 1, the printer 2, and the sewing machine 4 via the access point AP.

The sewing machine 4 is driven based on embroidery data to sew an embroidery pattern on a medium M having a print pattern printed by the printer 2 and having been cut along a cutting line by the cutting machine 3. The sewing machine 4 includes a CPU 41, a storage unit 42, a sewing unit 43, a display 44, an input unit 45, and a communication unit 46. The storage unit 42 stores programs and embroidery data to be executed by the CPU 41. The sewing unit 43 includes an upper shaft driving unit and an embroidery hoop moving unit. The upper shaft driving unit reciprocates a sewing needle connected to a needle bar (not shown) up and down. The embroidery hoop moving unit moves an embroidery hoop 4A that holds the medium M. The CPU 41 controls the sewing unit 43 based on the embroidery data stored in the storage unit 42 and synchronously drives the upper shaft driving unit and the embroidery hoop moving unit to sew an embroidery pattern on the medium M held by the embroidery hoop 4A.

The display 44 is an LCD (liquid crystal display). The input unit 45 is a touch screen provided on the display 44. The communication unit 46 is a communication module for communicating with the smartphone 1, the printer 2, and the cutting machine 3 via the access point AP.

The smartphone 1 includes a CPU 11, a storage unit 12, a display 13, an input unit 14, and a communication unit 15. The CPU 11 performs overall control of the smartphone 1. The display 13 is an LCD (liquid crystal display). The input unit 14 is a touch screen provided on the display 13. The communication unit 15 is a communication module for communicating with the printer 2, the cutting machine 3, and the sewing machine 4 via the access point AP.

The storage unit 12 stores editing programs to be executed by the CPU 11. The storage unit 12 stores setting information of the printer 2 included in the system S (hereinafter referred to as first setting information), setting information of the cutting machine 3 included in the system S (hereinafter referred to as second setting information), and setting information of the sewing machine 4 included in the system S (hereinafter referred to as third setting information).

The storage unit 12 further stores a work database containing a plurality of works that can be created using the printer 2, the cutting machine 3, and the sewing machine 4 of the system S. Each of the plurality of works can be created by using the medium M to be processed through steps of printing a print pattern by the printer 2, cutting by the cutting machine 3, and sewing an embroidery pattern by the sewing machine 4. Further, the storage unit 12 stores print data, cutting data, and embroidery data used for creating a work contained in the work database for an individual work basis.

The smartphone 1 receives a work that the user desires to create in response to an operation by the user. Further, the smartphone 1 changes a print pattern, cutting lines, and an embroidery pattern for creating the received work in response to an operation by the user. The smartphone 1 edits the print data stored in the storage unit 12 so that the changed print pattern can be printed. The smartphone 1 edits the cutting data stored in the storage unit 12 so that the medium M can be cut along the changed cutting lines. The smartphone 1 edits the embroidery data stored in the storage unit 12 so that the changed embroidery pattern can be sewn. Hereinafter, the print data, the cutting data, and the embroidery data are collectively referred to as processing data. The printer 2, the cutting machine 3, and the sewing machine 4 are collectively referred to as processing equipment. In the present embodiment, communication is performed via the access point AP, but a configuration in which direct communication is performed between the communication units 15, 26, 36, and 46 may be adopted.

Change of Print Pattern, Cutting Line, and Embroidery Pattern

With reference to FIGS. 2 to 6, the smartphone 1 is used to select a work and change a print pattern, a cutting line, and an embroidery pattern corresponding to the selected work in the example described below. An operation performed by the user by touching the display 13 is referred to as an input operation. The smartphone 1 can detect whether an input operation has been performed using the input unit 14.

First, the user of the smartphone 1 performs an input operation for activating an editing application for editing processing data. The smartphone 1 displays a selection screen D11 (refer to a screen A in FIG. 2) on the display 13 in response to the input operation. As illustrated in the screen A in FIG. 2, the selection screen D11 displays a plurality of sample images G11 indicating individual works. Each of the works corresponding to one of the sample images G11 can be created by using the medium M to be processed through steps of printing a print pattern by the printer 2, cutting by the cutting machine 3, and sewing an embroidery pattern by the sewing machine 4.

The user performs an input operation for selecting a sample image G11 corresponding to a desired work from the plurality of sample images G11. The smartphone 1 switches the screen on the display 13 to a work image screen D12 (refer to a screen B in FIG. 2) in response to the input operation. As illustrated in the screen B in FIG. 2, the work image screen D12 displays an image G12 which is an enlarged view of the selected sample image G11. The work displayed on the work image screen D12 is, for example, a cushion. For example, when the user wants to select a different work, the user performs an input operation of selecting "Back". The smartphone 1 switches the screen on the display 13 back to the selection screen D11 (refer to the screen A in FIG. 2) in response to the input operation.

For example, when the user decides to create a work indicated by the work image screen D12, the user performs an input operation for selecting the image G12 by tapping Create. The smartphone 1 switches the screen on the display 13 to a preview screen D13 (refer to a screen C in FIG. 2) in response to the input operation. As illustrated in the screen C in FIG. 2, the preview screen D13 shows the medium M to be processed for creating the work shown on the work image screen D12 (refer to the screen B in FIG. 2). Since the corresponding work is a cushion, the preview screen D13 includes a medium image G13 indicating a front-face medium M1 that is to be the front face of the cushion and a medium image G14 indicating a back-face medium M2 that is to be the back face of the cushion. The medium images G13 and G14 each include an embroidery pattern to be printed by the printer 2 and an embroidery pattern to be sewn by the sewing machine 4. The edges of the medium images G13 and G14 indicate cutting lines along which the materials M1 and M2 are cut from the medium M by the cutting machine 3.

Here, for example, when the user wants to edit processing data necessary for creating a different work, the user repeatedly performs an input operation of selecting "Back". The smartphone 1 switches the screen on the display 13 back to the work image screen D12 (refer to the screen B in FIG. 2) or the selection screen D11 (refer to the screen A in FIG. 2) in response to the input operations.

For example, the user changes a print pattern to be printed on the medium M in order to create the selected work. In this case, the user performs an input operation of selecting the print pattern in the medium image G13 or G14 included in the preview screen D13. The smartphone 1 switches the screen on the display 13 to a first preview screen D21 (refer to a screen A in FIG. 3) in response to the input operation. As illustrated in the screen A in FIG. 3, the first preview screen D21 includes a print image G21 indicating how a print pattern is printed on the medium M.

Further, the user performs an input operation of selecting the print image G21 included in the first preview screen D21 in order to change the print pattern displayed on the first preview screen G21. The smartphone 1 switches the screen on the display 13 to a first editing screen D22 (refer to a screen B in FIG. 3) in response to the input operation. As illustrated in the screen B in FIG. 3, the first editing screen D22 includes a plurality of candidate images G22 indicating selectable print patterns, and a selected image G22 indicating a print pattern selected by the user from among the plurality of candidate images G23.

The user performs an input operation of selecting an image indicating the desired print pattern from the candidate images G22. In response to the input operation, the smartphone 1 displays an enlarged view of the image elected from the candidate images G22 as the selected image G23. After changing the type of print pattern, the user performs an input operation of selecting "Back". The smartphone 1 switches the screen on the display 13 back to the first preview screen D21 (refer to the screen A in FIG. 3) in response to the input operation. In this case, the print pattern of the print image G21 included in the first preview screen D21 is replaced with the print pattern of the selected image G23 of the first editing screen D22.

The user performs an input operation of selecting "Back". The smartphone 1 switches the screen on the display 13 back to the preview screen D13 (refer to a screen C in FIG. 2) in response to the input operation. In this case, the print pattern of each of the medium images G13 and G14 included in the preview screen D13 is replaced with the print pattern of the print image G21 included in the first preview screen D21 (refer to the screen A in FIG. 3). Hereinafter, the first preview screen D21 and the first editing screen D22 are collectively referred to as a first screen D2.

For example, the user changes at least one of the position and size (i.e., length) of a cutting line for cutting out the front-face medium M1 or the back-face medium M2 used to create the selected work. In this case, the user performs an input operation of selecting an edge of the medium image G13 or G14 included in the preview screen D13. The smartphone 1 switches the screen on the display 13 to a second preview screen D31 (refer to a screen A in FIG. 4) in response to the input operation. As illustrated in the screen A in FIG. 4, the second preview screen D31 includes a cutting image G31 indicating a cutting line for cutting out the front-face medium M1 and a cutting image M2 indicating a cutting line for cutting out the back-face material G32.

To change the position of the cutting line, the user performs an input operation of selecting and dragging any part of the cutting image D31 or G32 included in the second preview screen G31. In contrast, to change the size of the cutting line, the user performs an input operation of selecting and dragging an end of the cutting image G31 or G32 included in the second preview screen D31.

The smartphone 1 switches the screen on the display 13 to a second editing screen D32 (refer to a screen B in FIG. 4) in response to the input operation. As illustrated in the screen B in FIG. 4, the second editing screen D32 includes embroidery images G33 and G34 each indicating an embroidery pattern with its position or size changed in accordance with dragging by the user. The cutting image G33 indicates a cutting line for cutting out the front medium M1. The cutting image G34 indicates a cutting line for cutting out the back-face medium M2. After changing the position or size of the cutting line, the user performs an input operation of selecting "Back". The smartphone 1 switches the screen on the display 13 to a second preview screen D31 (refer to the screen A in FIG. 4) in response to the input operation. In this case, the cutting lines indicated by the cutting images G31 and G32 included in the second preview screen D31 are switched to the cutting lines indicated by the cutting images G33 and G34 included in the second editing screen D32.

The user performs an input operation of selecting "Back". The smartphone 1 switches the screen on the display 13 back to the preview screen d13 (refer to the screen C in FIG. 2) in response to the input operation. In this case, the positions and sizes of the medium images G13 and G14 included in the preview screen D13 are switched to the positions and sizes of the cutting images G31 and G32 included in the second preview screen D31 (refer to the screen A in FIG. 4). Hereinafter, the second preview screen D31 and the second editing screen D32 are collectively referred to as a second screen D3.

For example, the user changes at least one of a type, position, and size of an embroidery pattern to be sewn on each medium M1, M2, in order to create the selected work. In this case, the user performs an input operation of selecting the embroidery pattern in the medium image G13 or G14 included in the preview screen D13. The smartphone 1 switches the screen on the display 13 to a third preview screen D41 (refer to a screen A in FIG. 5) in response to the input operation. As illustrated in the screen A in FIG. 5, the third preview screen D41 includes an embroidery image G41 representing the front-face medium M1 having an embroidery pattern sewn and an embroidery image G42 representing the back-face medium M2 having an embroidery pattern sewn.

For example, the user changes an embroidery pattern on the third preview screen D41. In this case, the user performs an input operation of selecting the embroidery pattern in the embroidery image G41 or G42 included in the third preview screen D41. To change an embroidery pattern to be sewn on the front-face medium M1, the user selects the embroidery pattern in the embroidery image G41, and to change an embroidery pattern to be sewn on the back-face medium M2, the user selects the embroidery pattern in the embroidery image G42. The smartphone 1 switches the screen on the display 13 to a third editing screen D42 (refer to a screen B in FIG. 5) in response to the input operation. As illustrated in the screen B in FIG. 5, the third editing screen D42 includes a plurality of candidate images G43 indicating selectable embroidery patterns, and a selected image G44 indicating an embroidery pattern selected by the user from among the plurality of candidate images G43.

The user performs an input operation of selecting an image indicating the desired embroidery pattern from the candidate images G43. In response to the input operation, the smartphone 1 displays an enlarged view of the image selected from the candidate images G43 as the selected image G44. After changing the type of embroidery pattern, the user performs an input operation of selecting "Back". The smartphone 1 switches the screen on the display 13 back to the third preview screen D41 (refer to the screen A in FIG. 5) in response to the input operation. In this case, the embroidery pattern of the embroidery image D41 or G42 selected by the user on the third preview screen G41 is switched to the embroidery pattern of the selected image D44 of the third editing screen G42.

For example, the user changes the position of an embroidery pattern in the embroidery image G41 or G42 on the third preview screen D41. In this case, the user performs an input operation of selecting and dragging the embroidery pattern in the embroidery image G41 or G42 included in the third preview screen D41. To change the position of an embroidery pattern to be sewn on the front-face medium M1, the user selects and drags the embroidery pattern in the embroidery image G41, and to change the position of an embroidery pattern to be sewn on the back-face medium M2, the user selects and drags the embroidery pattern in the embroidery image G42.

For example, the user changes the size of an embroidery pattern in the embroidery image G41 or G42 on the third preview screen D41. In this case, the user performs an input operation of selecting and pinching the embroidery pattern in the embroidery image G41 or G42 included in the third preview screen D41. To change the size of an embroidery pattern to be sewn on the front-face medium M1, the user selects and pinches the embroidery pattern in the embroidery image G41, and to change the size of an embroidery pattern to be sewn on the back-face medium M2, the user selects and pinches the embroidery pattern in the embroidery image G42.

The smartphone 1 switches the screen on the display 13 to a third editing screen D43 (refer to the screen C in FIG. 5) in response to the input operation. As illustrated in the screen C in FIG. 5, the third editing screen D43 includes embroidery images G45 and G46 each indicating an embroidery pattern with its position or size changed in accordance with dragging or pinching by the user. The embroidery image G45 indicates an embroidery pattern to be sewn on the front medium M1. The embroidery image G46 indicates an embroidery pattern to be sewn on the back-face medium M2. After changing the position or size of the embroidery pattern, the user performs an input operation of selecting "Back". The smartphone 1 switches the screen on the display 13 back to the third preview screen D41 (refer to the screen A in FIG. 5) in response to the input operation. In this case, the position and size of the embroidery pattern in each of the embroidery images G41 and G42 included in the third preview screen D41 are replaced with the position and size of the embroidery pattern in each of the embroidery images G45 and G46 included in the third editing screen D43.

The user performs an input operation of selecting "Back". The smartphone 1 switches the screen on the display 13 back to the preview screen D13 (refer to the screen C in FIG. 2) in response to the input operation. In this case, the type, position, and size of embroidery pattern in each of the medium images G13 and G14 included in the preview screen D13 are switched to the type, position, and size of embroidery pattern in each of the embroidery images G41 and G42 included in the third editing screen D41 (refer to the screen A in FIG. 5). Hereinafter, the third preview screen D41 and the third editing screens D42 and D43 are collectively referred to as a third screen D4.

After changing the print pattern, the cutting line, and the embroidery pattern, the user performs an input operation of selecting "Back" on the preview screen D13. The smartphone 1 switches the screen on the display 13 to the work image screen D12 (refer to the screen B in FIG. 2) in response to the input operation.

Output of Processing Data

To start processing of the medium M to create a work indicated on the work image screen D12, the user performs an input operation of selecting "Create". The smartphone 1 switches the screen on the display 13 to a first reception screen D51 (refer to a screen A in FIG. 6) in response to the input operation.

Figure 6:
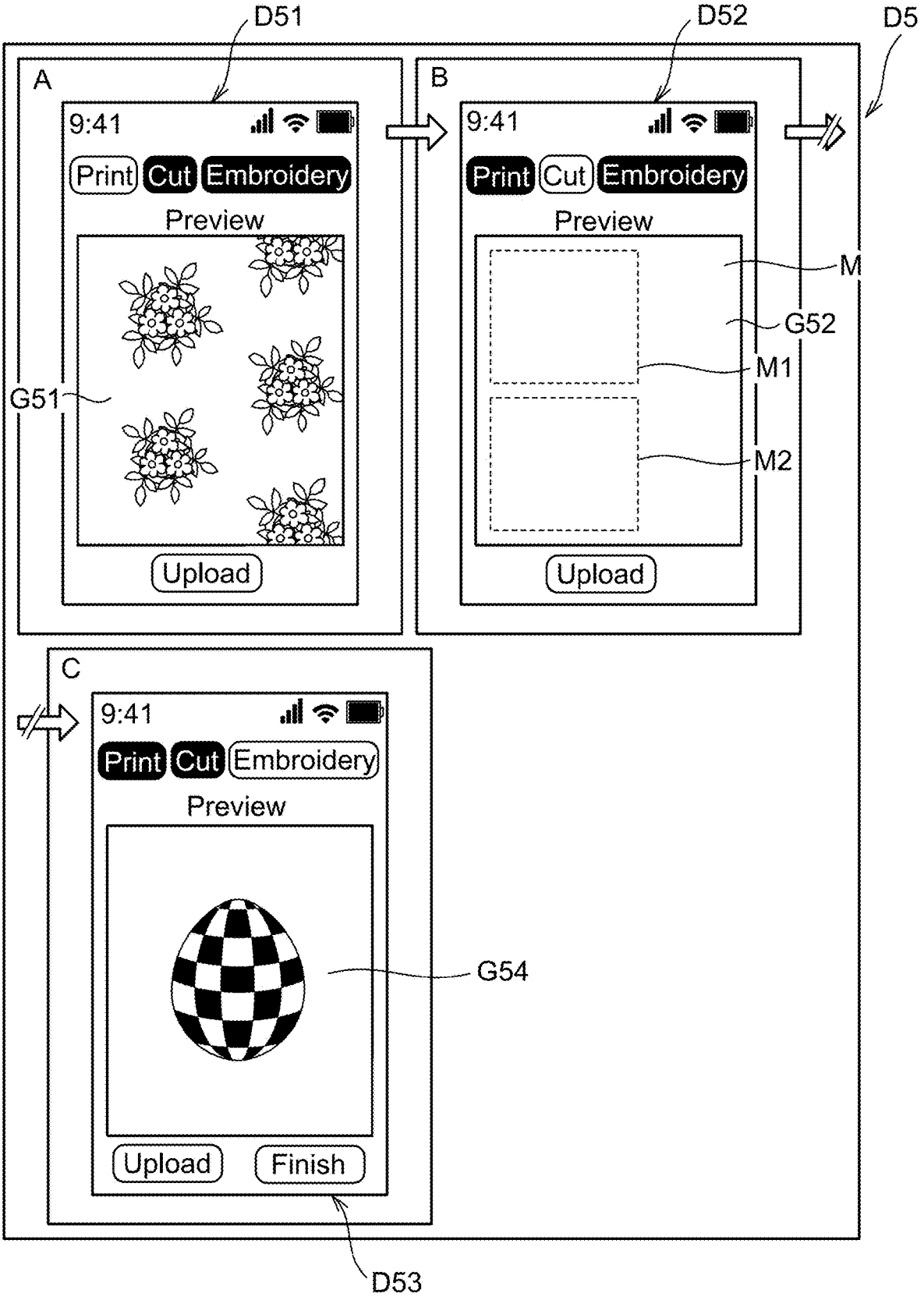
FIG. 6 illustrates a reception screen (including a first reception screen, a second reception screen, and a third reception screen).

As illustrated in the screen A in FIG. 6, the first reception screen D51 has "Print", "Cut", and "Embroidery", and "Print" is highlighted. The first reception screen D51 includes a print image G51 indicating that print patterns of the medium images G13 and G14 on the preview screen D13 (refer to the screen C in FIG. 2) are to be printed on the medium M.

To start printing the print pattern by the printer 2, the user first sets a medium M in the printer 2. The user performs an input operation of selecting "Upload" on the first reception screen D51. In response to the input operation, the smartphone 1 edits the print data stored in the storage unit 12 so that the print pattern indicated by the print image G51 can be printed. Further, the smartphone 1 transmits the edited print data to the printer 2 via the access point AP.

The printer 2 having received the print data from the smartphone 1 via the access point AP is driven based on the received print data to print a print pattern on the medium M.

The user performs an input operation of selecting "Cut" on the first reception screen D51 after the input operation of selecting "Upload". The smartphone 1 switches the screen on the display 13 to a second reception screen D52 (refer to a screen B in FIG. 6) in response to the input operation.

As illustrated in the screen B in FIG. 6, the second reception screen D52 has "Print", "Cut", and "Embroidery", and "Cut" is illustrated as highlighted. The second reception screen D52 includes a cutting image G52 indicating dotted rectangles overlayed on the medium M. The dotted lines represent edges of the medium images G13 and G14 shown on the preview screen D13 (refer to a screen C in FIG. 2). The dotted line of the upper rectangle in the cutting image G52 indicates a cutting line for cutting the front-face medium M1 from the medium M, and the dotted line of the lower rectangle in the cutting image G52 indicates a cutting line for cutting the back-face medium M2 from the medium M.

To start cutting the medium M by the cutting machine 3, the user takes out, from the printer 2, the medium M on which the print pattern has been printed and sets the medium M in the cutting machine 3. The user performs an input operation of selecting "Upload" on the second reception screen D52. The smartphone 1 edits the cutting data stored in the storage unit 12 so that the medium M can be cut along the cutting lines indicated in the cutting image G52. The smartphone 1 transmits the edited cutting data to the cutting machine 3 via the access point AP.

When receiving the cutting data from the smartphone 1 via the access point AP, the cutting machine 3 is driven based on the received cutting data to cut the medium M along the cutting lines. Thus, the front-face medium M1 and the back-face medium M2 are cut from the medium M.

After the input operation of selecting "Upload" on the second reception screen D52, the user performs an input operation of selecting "Embroidery". The smartphone 1 switches the screen on the display 13 to a third reception screen D53 (refer to the screen C in FIG. 6) in response to the input operation.

As illustrated in the screen C in FIG. 6, the third reception screen D53 has "Print", "Cut", and "Embroidery", and "Embroidery" is highlighted. In addition, the third reception screen D53 includes an embroidery image G54 indicating the embroidery pattern included in the medium images G13 and G14 on the preview screen D13 (refer to the screen C in FIG. 2).

To start sewing the embroidery pattern by the sewing machine 4, the user takes out the materials M1 and M2, which have been cut out along the cutting lines, from the cutting machine 3, and sets the medium M1 or M2 in the sewing machine 4. The user performs an input operation of selecting "Upload" on the third reception screen D53. The smartphone 1 edits the embroidery data stored in the storage unit 12 so that the embroidery pattern indicated by the embroidery image G54 can be sewn. The smartphone 1 transmits the edited embroidery data to the sewing machine 4 via the access point AP. Finally, the user selects "Finish" to end the editing application.

The sewing machine 4 having received the embroidery data from the smartphone 1 via the access point AP is driven based on the received embroidery data to stitch the embroidery pattern on each medium M1, M2.

Main Process

Referring to FIGS. 7 to 13, a main process is described. In response to detecting of an input operation of activating the editing application for editing processing data, the CPU 11 starts the main process by reading and executing the editing program stored in the storage unit 12.

First, the CPU 11 reads and obtains first setting information, second setting information, third setting information, and the work database, which are stored in the storage unit 12 (S11).

The first setting information includes information indicating print patterns that can be printed by the printer 2. The first setting information includes information indicating maximum and minimum ranges in which the printer 2 can print a print pattern. The maximum range is hereinafter referred to as a first maximum range and the minimum range is hereinafter referred to as a first minimum range. For example, the first maximum range is indicated by coordinate information on a maximum area of the medium M that can be set in and printed by the printer 2. For example, the first minimum range is defined by a minimum printing area used for performing printing at a resolution higher than a resolution designated in advance. The first setting information includes an edit condition for editing print data to enable the printer 2 to print a print pattern. The edit condition is hereinafter referred to as a first edit condition. The first edit condition relates to, for example, ink colors and image resolution used for printing.

The second setting information includes information indicating maximum and minimum ranges in which the cutting machine 3 can do cutting along a cutting line. The maximum range is hereinafter referred to as a second maximum range and the minimum range is hereinafter referred to as a second minimum range. For example, the second maximum range is indicated by coordinate information on a maximum area for the medium M that can be set in and cut by the cutting machine 3. For example, the second minimum range is defined by a minimum cutting area used for cutting the medium M by specifications designated in advance. The second setting information includes an edit condition for editing cutting data to enable the cutting machine 3 to cut the medium M along a cutting line. The edit condition is hereinafter referred to as a second edit condition. The second edit condition relates to, for example, the curvature of a cutting line.

The third setting information includes information indicating embroidery patterns that can be sewn by the sewing machine 4. The third setting information includes information indicating maximum and minimum ranges in which the printer 4 can sew an embroidery pattern. The maximum range is hereinafter referred to as a third maximum range and the minimum range is hereinafter referred to as a third minimum range. For example, the third maximum range is indicated by coordinate information on a maximum area of the medium M that can be held by the embroidery hoop 4A of the sewing machine 4. For example, the third minimum range is defined by a minimum embroidery area used for sewing an embroidery pattern by specifications designated in advance. The third setting information includes an edit condition for editing embroidery data to enable the sewing machine 4 to sew an embroidery pattern. The edit condition is hereinafter referred to as a third edit condition. The third edit condition relates to, for example, thread colors used in embroidery patterns and usable stitch types.

The CPU 11 obtains, from the work database obtained at S11, a work that can be created using the printer 2, the cutting machine 3, and the sewing machine 4 included in the system S. The CPU 11 controls the display 13 to display a selection screen D11 (refer to the screen A in FIG. 2) (S13). The selection screen D11 includes a sample image G11 (refer to the screen A in FIG. 2) indicating a work obtained by referring to the work database.

The CPU 11 determines whether it has detected an input operation of selecting a sample image G11 (S15). In response to not detecting an input operation (S15: NO), the CPU 11 returns the process to S13. In response to detecting an input operation of selecting a sample image G11 (S15: YES), the CPU 11 identifies the selected sample image G11. The CPU 11 controls the display 13 to display a work image screen D12 (refer to the screen B in FIG. 2) including an image G12 which is an enlarged view of the identified sample image G11 (S17).

The CPU 11 determines whether it has detected an input operation of selecting an image G12. In response to not detecting an input operation, the CPU 11 determines that the input operation for changing the print pattern, the cutting line, and the embroidery pattern is not performed (S19: NO). In this case, the CPU 11 proceeds the process to S37. In response to detecting an input operation of selecting an image G12, the CPU 11 determines that an input operation for changing a print pattern, a cutting line, and an embroidery pattern has been performed (S19: YES). In this case, the CPU 11 proceeds the process to S21.

The CPU 11 refers to the work database to determine print data, cutting data, and embroidery data used for creating the work represented by the selected image G12 (S21). The CPU 11 controls the display 13 to display a preview screen D13 (refer to the screen C in FIG. 2) including the medium images G13 and G14 indicating the media M1 and M2 to which printing of the determined print pattern, cutting along the determined cutting line, and sewing of the determined embroidery pattern are to be performed (S23).

In response to detecting an input operation of selecting a print image in the medium image G13 or G14 included in the preview screen D13, the CPU 11 determines that an input operation of changing a print pattern to edit the print data has been performed (S25: YES). In this case, the CPU 11 executes a first change process (refer to FIG. 11) (S27). Details of the first change process will be described later. After the first change process ends, the CPU 11 returns the process to S25.

In response to detecting an input operation of selecting an edge of the medium image G13 or G14 included in the preview screen D13, the CPU 11 determines that an input operation of changing a cutting line to edit the cutting data has been performed (S25: NO, S29: YES). In this case, the CPU 11 executes a second change process (refer to FIG. 12) (S31). Details of the second change process will be described later. After the second change process ends, the CPU 11 returns the process to S25.

In response to detecting an input operation of selecting an embroidery pattern in the medium image G13 or G14 included in the preview screen D13, the CPU 11 determines that an input operation of changing the embroidery pattern to edit the embroidery data has been performed (S25: NO, S29: NO, S33: YES). In this case, the CPU 11 executes a third change process (refer to FIG. 13) (S35). Details of the third change process will be described later. After the third change process ends, the CPU 11 returns the process to S25.

Figure 11:
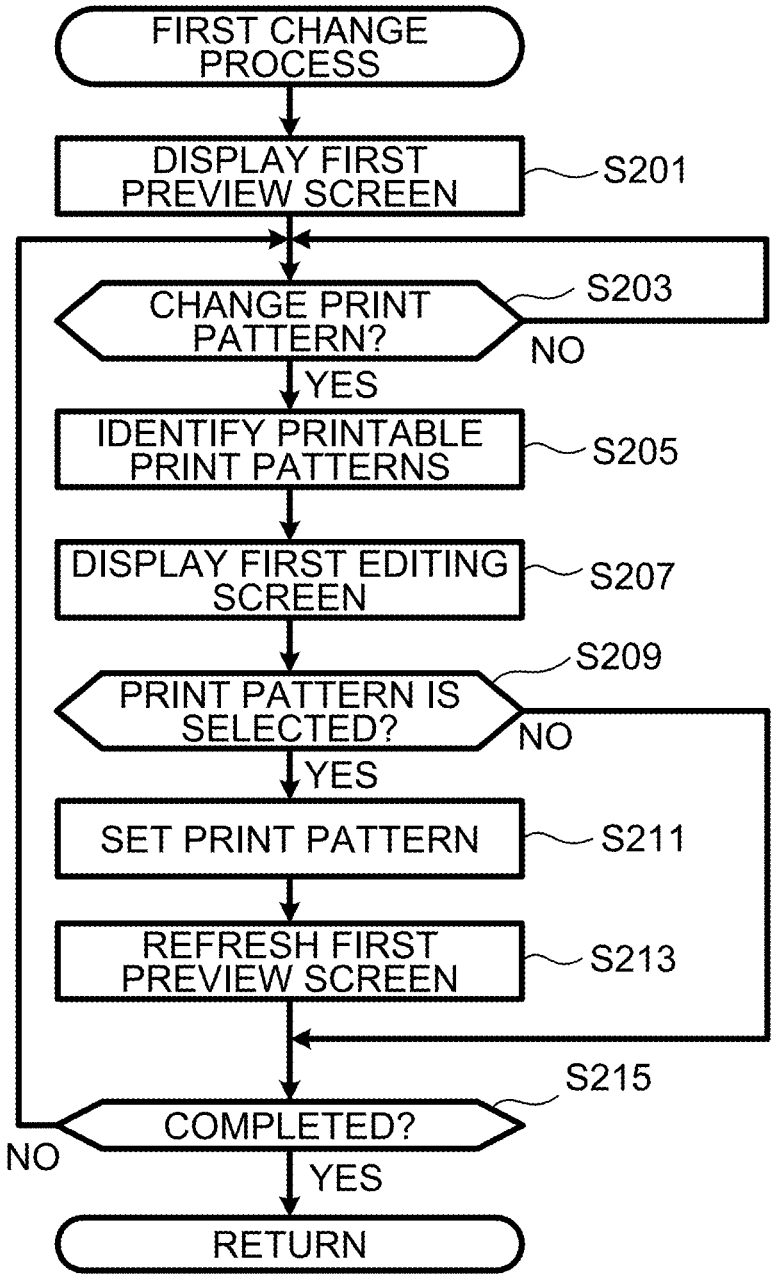
FIG. 11 is a flowchart of a first change process.

Referring to FIG. 11, the first change process is described. The CPU 11 controls the display 13 to display a first preview screen D21 (refer to the screen A in FIG. 3) for accepting an operation of changing a print pattern (S201). In response to not detecting an input operation of selecting the print image G21 included in the first preview screen D21, the CPU 11 determines that an input operation for changing a print pattern is not started (S203: NO). In this case, the CPU 11 returns the process to S203. In response to detecting an input operation of selecting the print image G21 included in the first preview screen D21, the CPU 11 determines that an input operation for changing a print pattern is started (S203: YES).

The CPU 11 identifies print patterns that can be printed by the printer 2 based on the first setting information obtained at S11 (refer to FIG. 7) (S205). The CPU 11 controls the display 13 to display the first editing screen D22 (refer to the screen B in FIG. 3) indicating the identified print patterns as the candidate images G22 (S207).

In response to detecting an input operation of selecting a candidate image G22, the CPU 11 determines that a print pattern is selected (S209: YES). In this case, the CPU 11 sets the selected print pattern as the print pattern to be printed on the medium M by the printer 2 (S211). In response to detecting an input operation of selecting "Back" on the first editing screen D22, the CPU 11 controls the display 13 to refresh the first preview screen D21 (refer to the screen A in FIG. 3) to display the set print pattern in the print image G21 (S213). In this case, the CPU 11 proceeds the process to S215.

In response to not detecting an input operation of selecting a candidate image G22, the CPU 11 determines that a print pattern is not selected (S209: NO). In this case, the CPU 11 proceeds the process to S215.

In response to not detecting an input operation of selecting "Back" on the first preview screen D21, the CPU 11 determines that an input operation of changing a print pattern (S215: NO). In this case, the CPU 11 proceeds the process to S203. In response to detecting an input operation of selecting "Back" on the first preview screen D21, the CPU 11 determines that an operation of changing a print pattern is completed (S215: YES). The CPU 11 controls the display 13 to display the preview screen D13 (refer to the screen C in FIG. 2) including the medium images G13 and G14 each indicating the selected print pattern. The CPU 11 ends the first change process to return the process to the main process (refer to FIG. 7).

Figure 12:
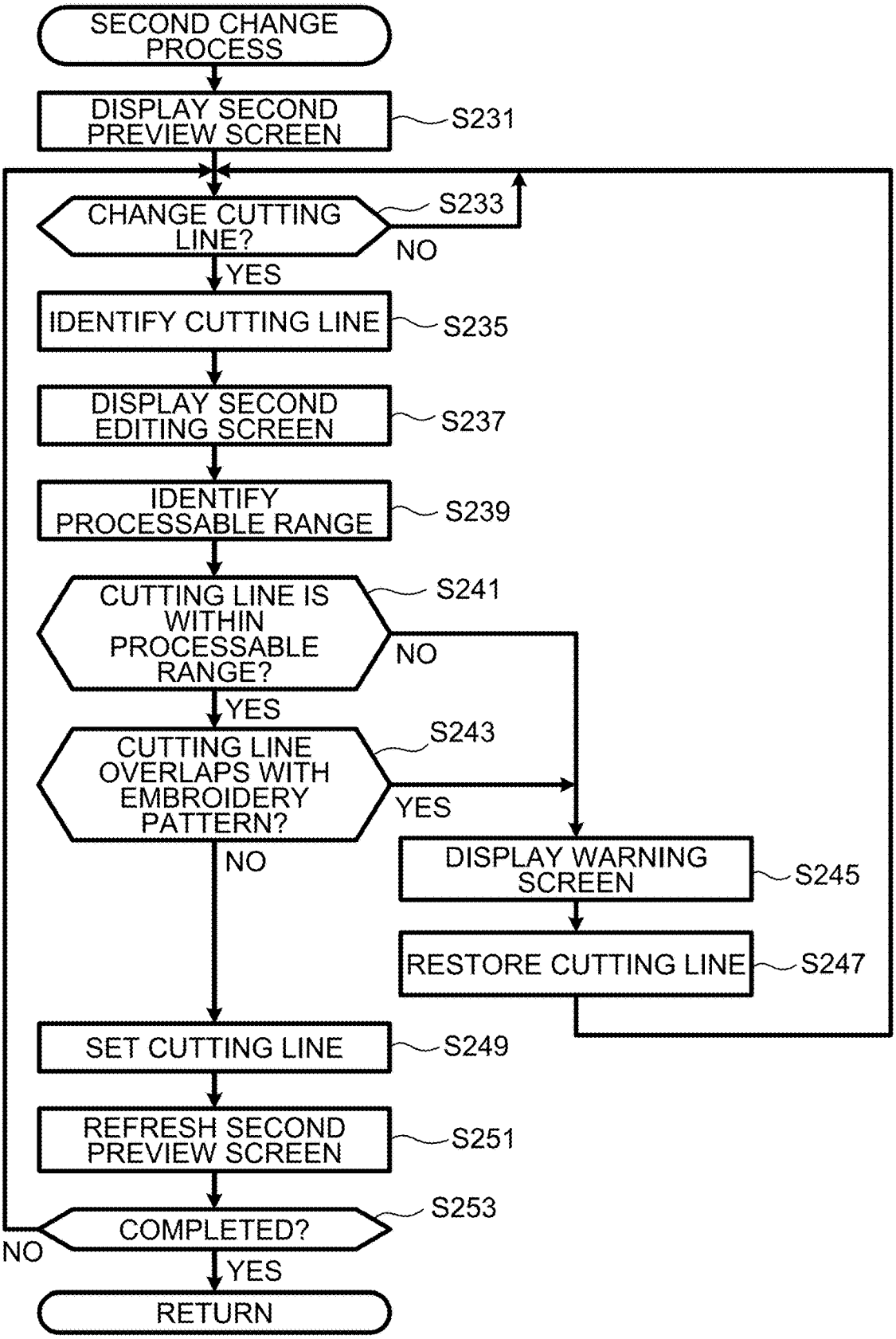
FIG. 12 is a flowchart of a second change process.

Referring to FIG. 12, the second change process is described. The CPU 11 controls the display 13 to display a second preview screen D31 (refer to the screen A in FIG. 4) for accepting an operation of changing a cutting line (S231). In response to not detecting an input operation of selecting and dragging a portion or edge of the cutting image G31 or G32 included in the second preview screen D31, the CPU 11 determines that an operation for changing a cutting line is not started (S233: NO). In this case, the CPU 11 returns the process to S233. In response to detecting the input operation of selecting and dragging a portion or edge of the cutting image G31 or G32 included in the second preview screen D31, the CPU 11 determines that an operation of changing a cutting line is started (S233: YES). The CPU 11 identifies a cutting line of which position or size has been changed based on the detected input operation (S235). The CPU 11 controls the display 13 to display the second editing screen D32 (refer to the screen B in FIG. 4) including the cutting images G31 and G32 indicating the identified cutting lines as the cutting images G33 and G34 (S237).

Figure 7:
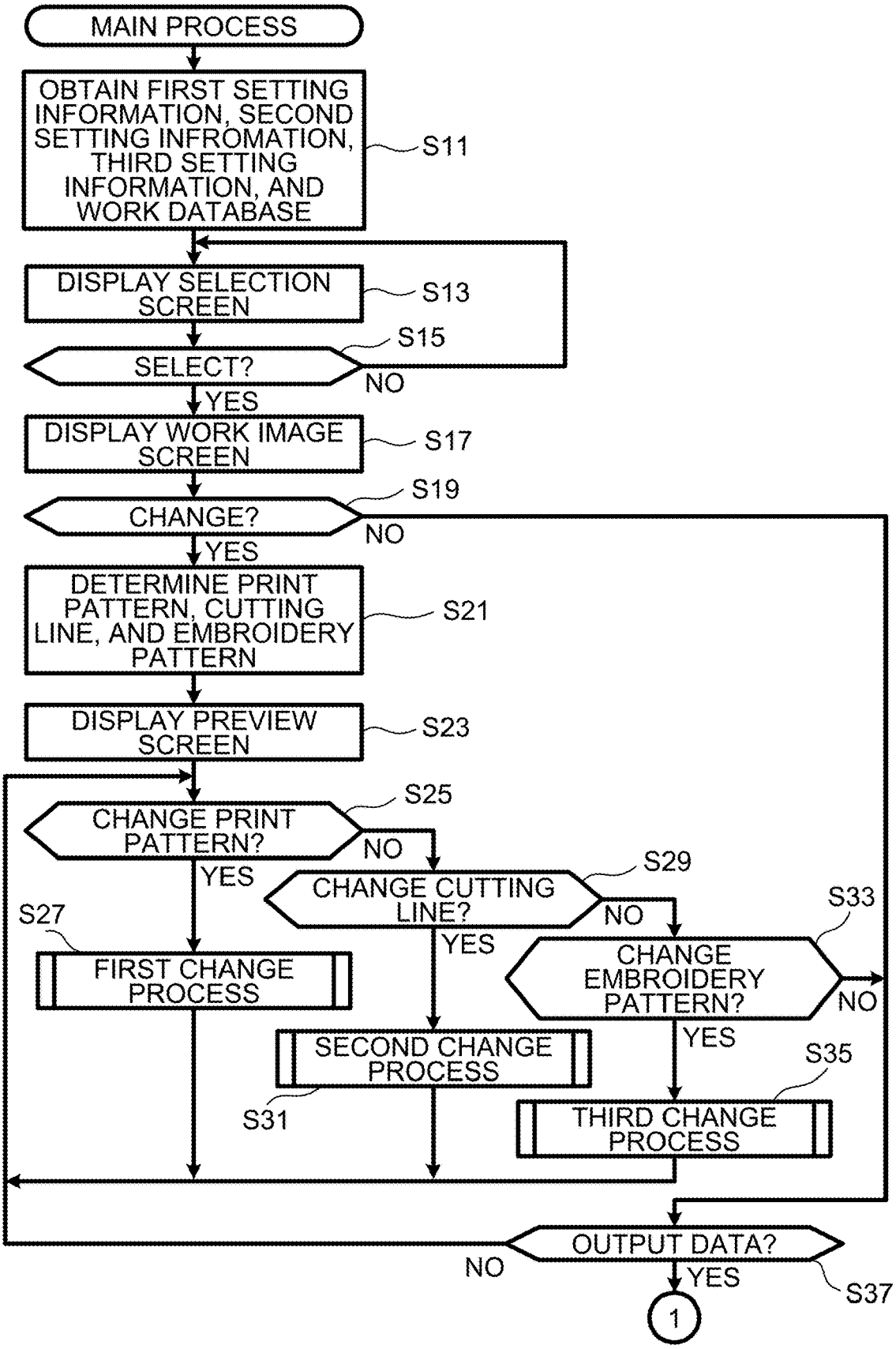
FIG. 7 is a flowchart of a main process.

The CPU 11 identifies the first maximum range, the first minimum range, the second maximum range, the second minimum range, the third maximum range, and the third minimum range based on the first setting information, the second setting information, and the third setting information obtained at S11 (refer to FIG. 7). The CPU 11 obtains the smallest range among the identified first maximum range, second maximum range, and third maximum range as a maximum range, and obtains the largest range among the first minimum range, second minimum range, and third minimum range as a minimum range. The CPU 11 further identifies a range larger than the minimum range and smaller than the maximum range as a processable range (S239).

The CPU 11 determines whether the changed cutting line identified at S235 is located within the processable range (S241). In response to determining that the cutting line is located within the processable range (S241: YES), the CPU proceeds 11 the process to S243. The CPU 11 then determines whether the changed cutting line identified at S235 overlaps with the embroidery pattern to be sewn by the sewing machine 4 (S243). In response to determining that the cutting line does not overlap the embroidery pattern (S243: NO), the CPU 11 proceeds the process to S247.

The CPU 11 sets the cutting line identified at S235, that is, the cutting line with its position or size changed in accordance with the input operation, as a cutting line along which the cutting machine 3 cuts the medium M (S249). In response to detecting an input operation of selecting "Back" on the second editing screen D32, the CPU 11 controls the display 13 to refresh the second preview screen D31 (refer to the screen A in FIG. 4) to display the cutting images G31 and G32 with the set cutting line (S251). In this case, the CPU 11 proceeds the process to S253.

In response to determining that the cutting line is not located within the processable range (S241: NO) or the cutting line overlaps with the embroidery pattern (S243: YES), the CPU 11 proceeds the process to S245. The CPU 11 controls the display 13 to display a warning screen for providing notification that the change of the position or size of the embroidery pattern is inappropriate (S245). The CPU 11 switches, on the second editing screen D32 displayed on the display 13, the cutting images G33 and G34 indicating the cutting lines after the change of its position or size back to the cutting images G33 and G34 indicating the cutting lines before the change (S247). In this case, the CPU 11 proceeds the process to S233.

In response to not detecting an input operation of selecting "Back" on the second preview screen D31 at S253, the CPU 11 determines that changing of the cutting lines is not completed (S253: NO). In this case, the CPU 11 returns the process to S233. In response to detecting an input operation of selecting "Back" on the second preview screen D31, the CPU 11 determines that changing of the cutting lines is completed (S253: YES). The CPU 11 controls the display 13 to display the preview screen D13 (refer to the screen C in FIG. 2) including the medium images G13 and G14 each indicating the set cutting lines. The CPU 11 ends the second change process to return the process to the main process (refer to FIG. 7).

Figure 13:
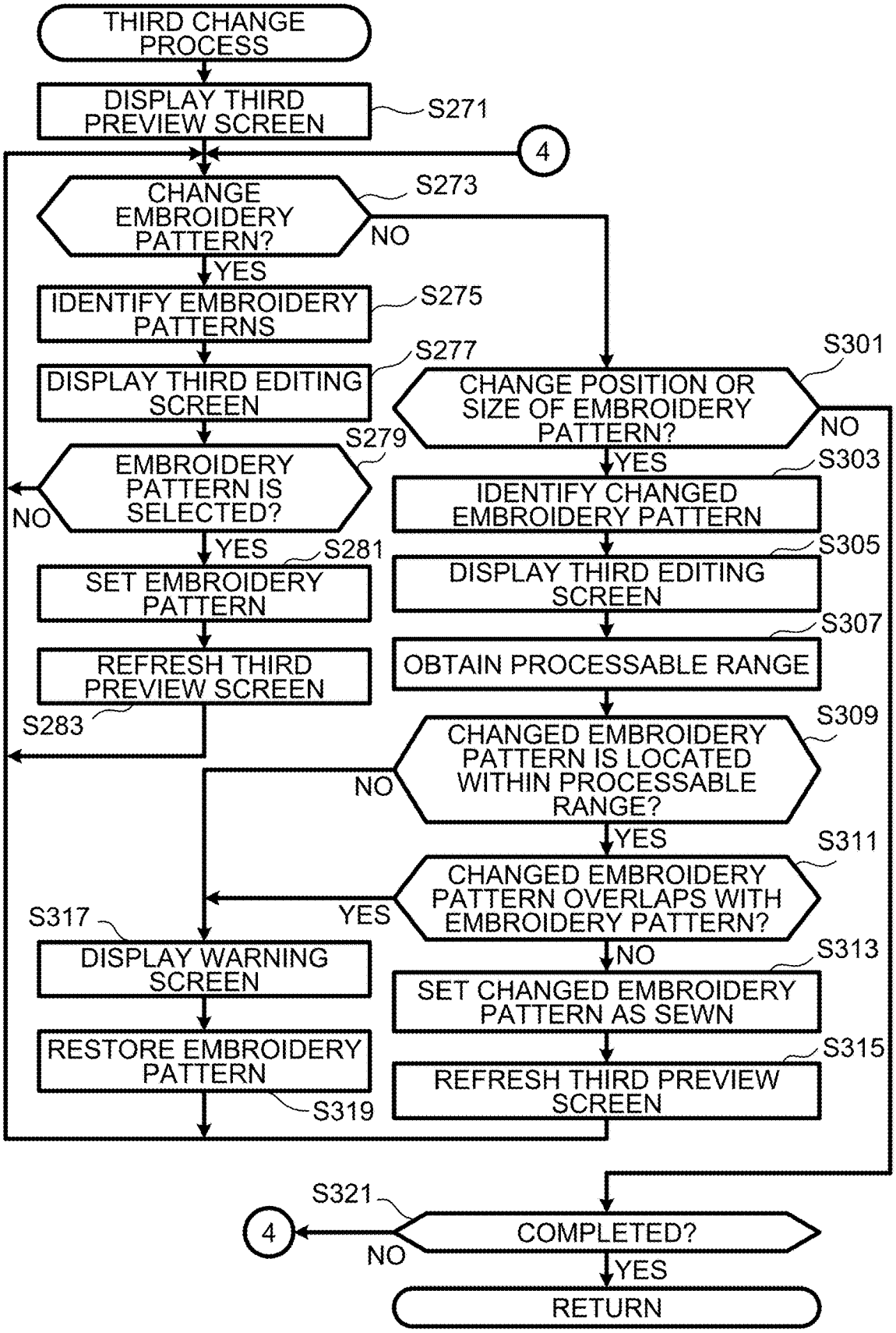
FIG. 13 is a flowchart of a third change process.

Referring to FIG. 13, the third change process is described. The CPU 11 controls the display 13 to display a third preview screen D41 (refer to the screen A in FIG. 5) for accepting an operation of changing an embroidery pattern (S271). In response to detecting an input operation of selecting the embroidery pattern in one of the embroidery images G41 and G42 included in the third preview screen D41, the CPU 11 determines that an operation of changing the embroidery pattern is started (S273: YES).

The CPU 11 identifies embroidery patterns that can be sewn by the sewing machine 4 based on the third setting information obtained at S11 (refer to FIG. 7) (S275). The CPU 11 controls the display 13 to display the third editing screen D42 (refer to the screen B in FIG. 5) indicating the identified embroidery patterns as the candidate patterns G43 (S277).

In response to detecting an input operation of selecting a candidate image G43, the CPU 11 determines that an embroidery pattern is selected (S279: YES). In this case, the CPU 11 sets the selected embroidery pattern as the embroidery pattern to be sewn on the medium M by the sewing machine 4 (S281). In response to detecting an input operation of selecting "Back" on the third editing screen D42, the CPU 11 controls the display 13 to update the third preview screen D41 (refer to the screen A in FIG. 5) to display the set embroidery pattern in each of the embroidery images G41 and G42 (S283). The CPU 11 returns the process to S273.

In response to not detecting an input operation of selecting a candidate image G43, the CPU 11 determines that an embroidery pattern is not selected (S279: NO). In this case, the CPU 11 returns the process to S273.

In response to detecting an input operation of selecting and dragging or pinching an embroidery pattern in one of the embroidery mages G41 and G42 included in the third preview screen D41, the CPU 11 determines that an operation of changing the position or size of the embroidery pattern is started (S301: YES). The CPU 11 identifies an embroidery pattern of which position or size has been changed based on the detected input operation (S303). The CPU 11 controls the display 13 to display the third editing screen D43 (refer to the screen C in FIG. 5) including the embroidery patterns G45 and G46, at least one of which indicates the identified embroidery pattern (S305).

The CPU 11 obtains a maximum range and a minimum range based on the first setting information, the second setting information, and the third setting information obtained at S11 (refer to FIG. 7), and then obtains a range lager than the minimum range and smaller than the maximum range as a processable range (S307).

The CPU 11 determines whether the changed embroidery pattern identified at S303 is located within the processable range (S309). In response to determining that the embroidery pattern is located within the processable range (S309: YES), the CPU 11 proceeds the process to S311. The CPU 11 then determines whether the changed embroidery pattern identified at S303 overlaps the cutting line to be used by the cutting machine 3 to cut the medium M (S311). In response to determining that the embroidery pattern does not overlap the cutting line (S311: NO), the CPU 11 proceeds the process to S313.

The CPU 11 sets the embroidery pattern identified at S303, that is, the embroidery pattern with its position or size changed in accordance with the input operation, as an embroidery pattern to be sewn by the sewing machine 4 (S313). In response to detecting an input operation of selecting "Back" on the third editing screen D43, the CPU 11 controls the display 13 to update the third preview screen D41 (see the screen A in FIG. 5) to display the set embroidery pattern in each of the embroidery images G41 and G42 (S315). The CPU 11 proceeds the process to S273.

In response to determining that the embroidery pattern is not located within the processable range (S309: NO) or the embroidery pattern overlaps the cutting line (S311: YES), the CPU 11 proceeds the process to S317. The CPU 11 controls the display 13 to display a warning screen for providing notification that the change in the position or size of the embroidery pattern is inappropriate (S317). In this case, the CPU 11 switches, on the third editing screen D43 displayed on the display 13, the embroidery images G45 and G46 indicating the embroidery pattern after the change of the position or size back to the embroidery images G45 and G46 indicating the embroidery pattern before the change, and returns the embroidery pattern to the original (S319). The CPU 11 returns the process to S273.

In response to not detecting an input operation of selecting the embroidery pattern in one of the embroidery images G41 and G42 included in the third preview screen D41, the CPU 11 determines that an input operation for changing an embroidery pattern, its position, and its size is not started (S273: NO and S301: NO).

In response to not detecting an input operation of selecting "Back" on the third preview screen D41, the CPU 11 determines that editing of editing data is not completed (S321: NO). In this case, the CPU 11 returns the process to S273. In response to detecting an input operation of selecting "Back" on the third preview screen D41, the CPU 11 determines that changing of the embroidery pattern is completed (S321: YES). The CPU 11 controls the display 13 to display the preview screen D13 (refer to the screen C in FIG. 2) including the medium images G13 and G14 each indicating the selected print pattern. The CPU 11 ends the third change process to return the process to the main process (refer to FIG. 7).

As illustrated in FIG. 7, in response to determining that none of the input operations for changing the print pattern, the cutting line, and the embroidery pattern has been performed (S25: NO, S29: NO, S33: NO), the CPU 11 determines that an input operation of selecting "Back" on the preview screen D13 has been performed, displays the work image screen D12 (refer to screen B in FIG. 2), and then determines whether the input operation for selecting "Create" has been performed. In response to not detecting an input operation of selecting Create, the CPU 11 determines not to output any data (S37: NO). In this case, the CPU 11 returns the process to S25. In contrast, in response to detecting an input operation of selecting Create, the CPU 11 determines that editing of the print pattern, the cutting line, and the embroidery pattern is completed (S37: YES). The CPU 11 proceeds the process to S51 (refer to FIG. 8).

Figure 8:
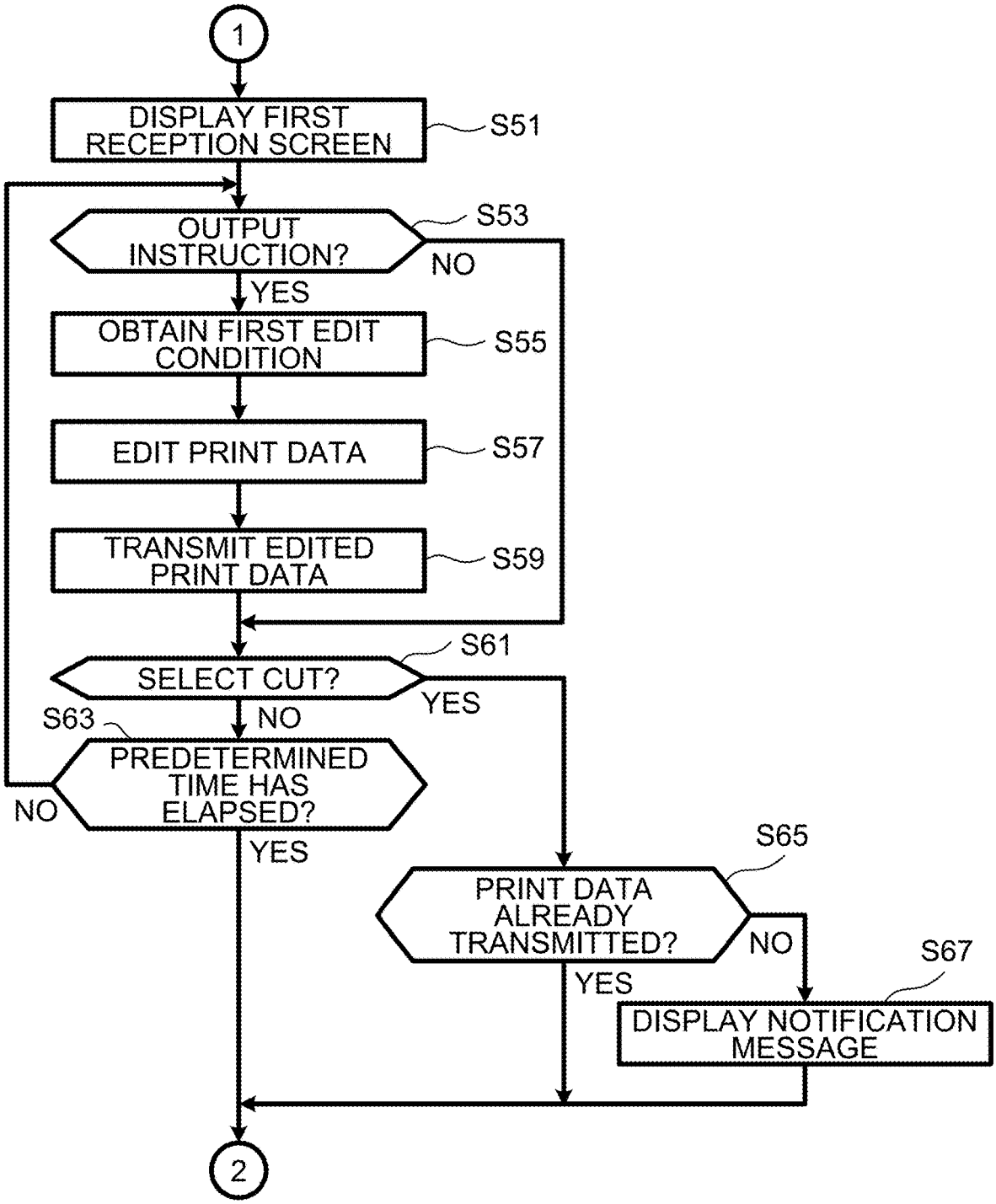
FIG. 8 is a flowchart of the main process continued from FIG. 7.

In response to determining YES at S37, as illustrated in FIG. 8 the CPU 11 controls the display 13 to display the first reception screen D51 (refer to the screen A in FIG. 6) (S51). The CPU 11 determines whether it has detected an input operation of selecting "Upload" (S53). In response to not detecting an input operation of selecting "Upload" (S53: NO), the CPU 11 proceeds the process to S61. In response to detecting an input operation of selecting "Upload", the CPU 11 determines that an instruction to output print data to the printer 2 has been input (S53: YES).

The CPU 11 obtains the first edit condition included in the first setting information obtained at S11 (refer to FIG. 7) (S55). The CPU 11 reads and obtains print data used for creating the work selected at S15 from the storage unit 12. The CPU 11 edits the print data (S57) based on the obtained first edit condition so as to enable the printer 2 to print the print pattern set at S211 of the first change process (refer to FIG. 11). Further, the CPU 11 transmits the edited print data to the printer 2 via the access point AP (S59). The CPU 11 proceeds the process to S61. The printer 2 having received the print data from the smartphone 1 via the access point AP is driven based on the received print data to print a print pattern on the medium M.

The CPU 11 determines whether it has detected an input operation of selecting "Cut" on the first reception screen D51 (S61). In response to not detecting the input operation of selecting "Cut" (S61: NO), the CPU 11 determines whether a first predetermined time has elapsed since the first reception screen D51 was displayed (S63). In response to determining that the first predetermine time has not elapsed (S63: NO), the CPU 11 returns the process to S53.

In response to detecting the input operation of selecting "Cut" before the first predetermined time elapses (S61: YES), the CPU 11 determines whether the print data has been already transmitted to the printer 2 at S59 (S65). In determining that the print data has been transmitted (S65: YES), the CPU 11 proceeds the process to S81 (refer to FIG. 9). In contrast, in response to determining that the print data has not been transmitted (S65: NO), the CPU 11 controls the display 13 to display a notification message for providing notification that the print data has not been transmitted (S67). The CPU 11 proceeds the process to S81 (refer to FIG. 9).

In response to determining that the first predetermined time has elapsed since the display of the first reception screen D51 was started without detecting the input operation of selecting "Cut" (S63: YES), the CPU 11 proceeds the process to S81 (refer to FIG. 9).

Figure 9:
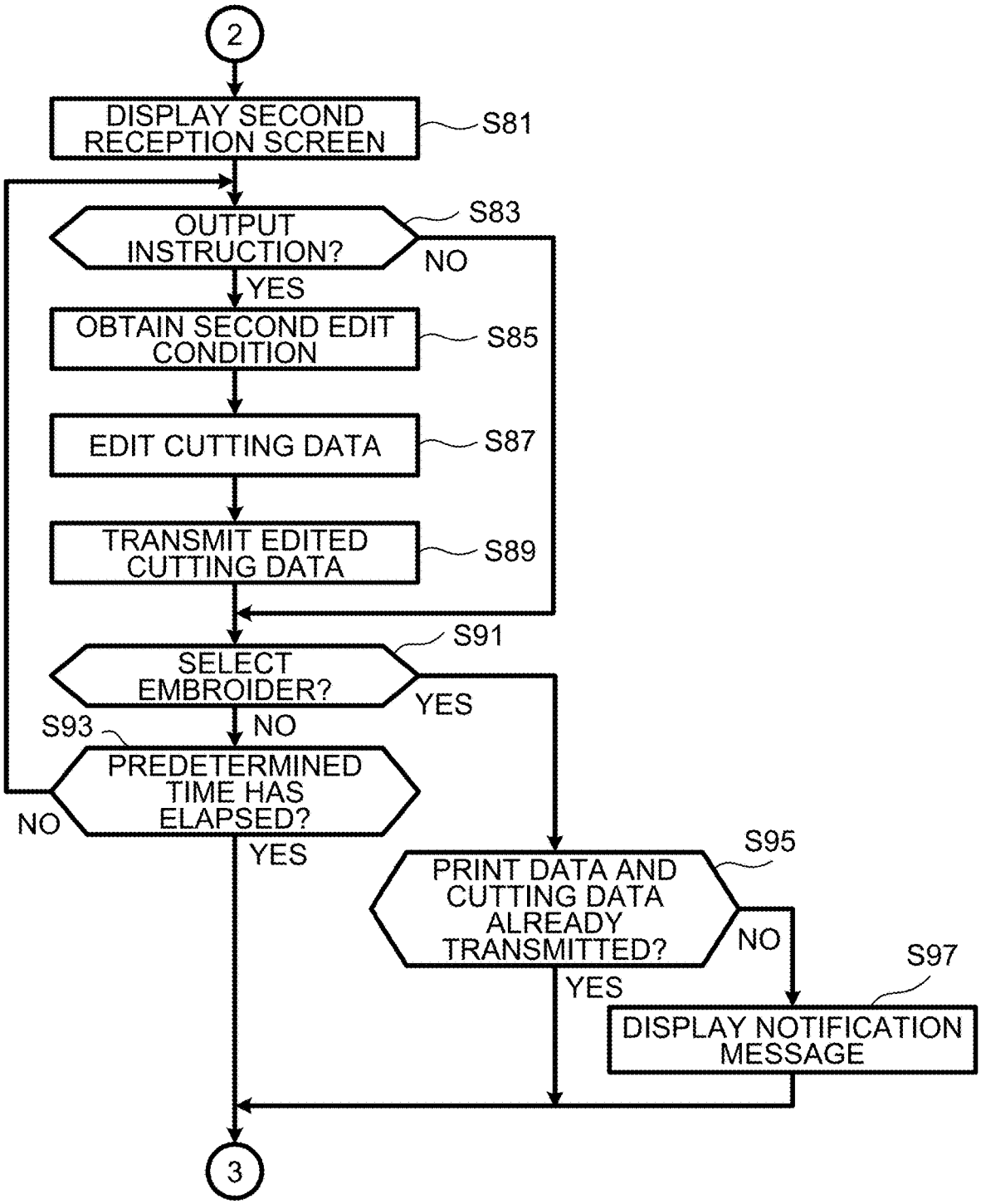
FIG. 9 is a flowchart of the main process continued from FIG. 8.

In response to determining YES at S63, S65, or S67, as illustrated in FIG. 9, the CPU 11 controls the display 13 to display the second reception screen D52 (refer to the screen B in FIG. 6) (S81). The CPU 11 determines whether it has detected an input operation of selecting "Upload" (S83). In response to not detecting an input operation of selecting "Upload" (S83: NO), the CPU 11 proceeds the process to S91. In response to detecting an input operation of selecting "Upload", the CPU 11 determines that an instruction to output cutting data to the cutting machine 3 has been input (S83: YES).

The CPU 11 obtains the second edit condition included in the second setting information obtained at S11 (refer to FIG. 7) (S85). The CPU 11 reads and obtains cutting data used for creating the work selected at S15 from the storage unit 12. The CPU 11 edits the obtained cutting data based on the obtained second edit condition so as to enable the cutting machine 3 to cut the medium M along the cutting line set at S249 of the second change process (refer to FIG. 12) (S87). The CPU 11 transmits the edited cutting data to the cutting machine 3 via the access point A (S89). The CPU 11 proceeds the process to S91. The cutting machine 3 having received the cutting data from the smartphone 1 via the access point AP is driven based on the received cutting data to cut the medium M along the cutting lines to produce the materials M1 and M2.

The CPU 11 determines whether it has detected an input operation of selecting "Embroidery" on the second reception screen D52 (S91). In response to not detecting the input operation of selecting Embroidery (S91: NO), the CPU 11 determines whether a second predetermined time has elapsed since the second reception screen D52 was displayed (S93). In response to determining that the second predetermine time has not elapsed (S93: NO), the CPU 11 returns the process to S83.

In response to detecting the input operation of selecting Embroidery before the second predetermined time elapses (S91: YES), the CPU 11 determines whether the print data has been already transmitted to the printer 2 at S59 (refer to FIG. 8) and that the cutting data has been already transmitted to the cutting machine 3 at S89 (S95). In determining that the print data and the cutting data have been already transmitted (S95: YES), the CPU 11 proceeds the process to S111 (refer to FIG. 10). In contrast, in response to determining that at least one of the print data and the cutting data has not been transmitted (S95: NO), the CPU 11 controls the display 13 to display a notification message for providing notification that the at least one of the print data and the cutting data has not been transmitted (S97). The CPU 11 proceeds the process to S111 (refer to FIG. 10).

In response to determining that the second predetermined time has elapsed since the display of the second reception screen D52 was started without detecting the input operation of selecting Embroidery (S93: YES), the CPU 11 proceeds the process to S111 (refer to FIG. 10).

Figure 10:
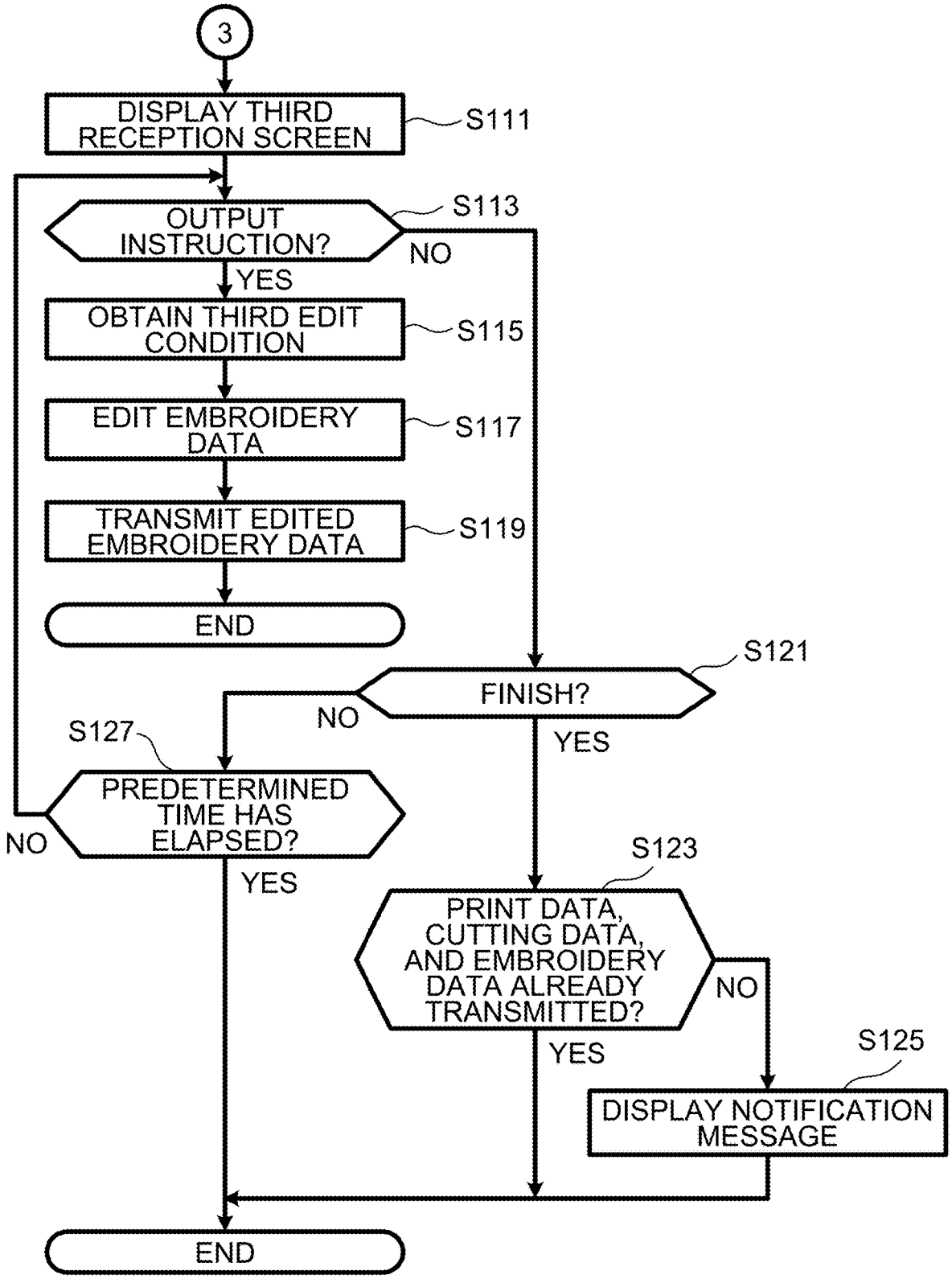
FIG. 10 is a flowchart of the main process continued from FIG. 9.

In response to determining YES at S93, S95, or S97, as illustrated in FIG. 10, the CPU 11 controls the display 13 to display the third reception screen D53 (refer to the screen C in FIG. 6) (S111). The CPU 11 determines whether it has detected an input operation of selecting "Upload" (S113). In response to detecting an input operation of selecting "Upload", the CPU 11 determines that an instruction to output embroidery data to the sewing machine 4 has been input (S113: YES).

The CPU 11 obtains the third edit condition included in the third setting information obtained at S11 (refer to FIG. 7) (S115). The CPU 11 reads and obtains embroidery data used for creating the work selected at S15 from the storage unit 12. The CPU 11 edits the obtained embroidery data in accordance with the obtained third edit condition so as to enable the sewing machine 4 to sew the embroidery pattern set at S281 or S313 (refer to FIG. 13) of the third change process (S117). The CPU 11 transmits the edited embroidery data to the sewing machine 4 via the access point A (S119). The CPU 11 ends the main process. The sewing machine 4 having received the embroidery data from the smartphone 1 via the access point AP is driven based on the received embroidery data to sew the print pattern set on the smartphone 1 on each medium M1, M2.

In response to not detecting an input operation of selecting "Upload" (S113: NO) on the third reception screen D53, the CPU 11 proceeds the process to S121. The CPU 11 determines whether it has detected an input operation of selecting "Finish" on the third reception screen D53 (S121). In response to not detecting the input operation of selecting "Finish" (S121: NO), the CPU 11 determines whether a third predetermined time has elapsed since the third reception screen D53 was displayed (S127). In response to determining that the third predetermine time has not elapsed (S127: NO), the CPU 11 returns the process to S113.

In response to detecting the input operation of selecting "Finish" before the third predetermined time elapses (S121: YES), the CPU 11 determines whether the print data has been already transmitted to the printer 2, the cutting data to the cutting machine 3, and the embroidery data to the sewing machine 4 (S123). In determining that all of the print data, the cutting data, and the embroidery data have been already transmitted (S123: YES), the CPU 11 ends the main process. In contrast, in response to determining that at least one of the print data, the cutting data, and the embroidery data has not been transmitted (S123: NO), the CPU 11 controls the display 13 to display a notification message for providing notification that the at least one of the print data, the cutting data, and the embroidery data has not been transmitted (S125). The CPU 11 ends the main process.

In response to determining that the third predetermined time has elapsed since the display of the third reception screen D53 was started without detecting the input operation of selecting "Finish" (S127: YES), the CPU 11 ends the main process.

Operations and Effects of the Embodiment

The smartphone 1 can edit the print data in accordance with a change of the print pattern, change the cutting data in accordance with a change of the cutting line, and edit the embroidery data in accordance with a change of the embroidery pattern at a time. The smartphone 1 transmits the edited print data to the printer 2, thereby enabling the printer 2 to print a print pattern on a medium M. The smartphone 1 transmits the edited cutting data to the cutting machine 3, thereby enabling the cutting machine 3 to cut the medium M along the cutting line. The smartphone 1 transmits the edited embroidery data to the sewing machine 4, thereby enabling the sewing machine 4 to sew the embroidery pattern on the medium M.

The smartphone 1 transmits the print data to the printer 2 prior to transmission of the cutting data to the cutting machine 3 and the embroidery data to the sewing machine 4. The smartphone 1 thus enables the printer 2 to print on the medium M before the cutting machine 3 cuts the medium M and the sewing machine 4 sews an embroidery pattern. In addition, the smartphone 1 transmits print data in response to a detected input operation with the first reception screen D51 being displayed. The smartphone 1 then switches the first reception screen D51 to the second reception screen D52. The smartphone 1 transmits cutting data in response to a detected input operation with the second reception screen D52 being displayed. The smartphone 1 thus enables the cutting machine 3 to cut the medium M after the printer 2 prints the print pattern.

The smartphone 1 then switches the second reception screen D52 to the third reception screen D53. The smartphone 1 transmits embroidery data in response to a detected input operation with the third reception screen D53 being displayed. The smartphone 1 thus enables the sewing machine 4 to sew the embroidery pattern after the cutting machine 3 cuts the medium M.

The smartphone 1 transmits the print data in response to an input operation from the user with the first reception screen D51 being displayed, the cutting data in response to an input operation from the user with the second reception screen D52 being displayed, and the embroidery data in response to an input operation from the user with the third reception screen D53 being displayed. The user can thus transmit each of the print data, the cutting data, and the embroidery data to a corresponding piece of the processing equipment (including the printer 2, the cutting machine 3, and the sewing machine 4) at a desired timing.

The smartphone 1 switches the first reception screen D51 to the second reception screen D52 in response to not detecting an input operation within the first predetermined time after the first reception screen D51 was displayed on the display 13 (S63: YES). The smartphone 1 switches the second reception screen D52 to the third reception screen D53 in response to not detecting an input operation within the second predetermined time after the second reception screen D52 was displayed on the display 13 (S93: YES). The smartphone 1 can thus switch the reception screen D5 to the next screen even when the user does not perform an input operation.

In response to detecting an input operation of switching the first reception screen D51 to the second reception screen D52 before transmission of the print data to the printer 2 (S61: YES and S65: NO), the smartphone 1 controls the display 13 to display a notification message (S67). In response to detecting an input operation of switching the second reception screen D52 to the third reception screen D53 before transmission of the print data to the printer 2 or the cutting data to the cutting machine 3 (S91: YES and S95: NO), the smartphone 1 controls the display 13 to display a notification message (S97). The smartphone 1 can thus notify the user that there is a possibility that the print data, the cutting data, and the embroidery data will be transmitted to the processing equipment in a different order.

The smartphone 1 changes a print pattern and edits print data in response to detecting an input operation of selecting the print image in the medium image G13 or G14 included in the preview screen D13. The smartphone 1 changes a cutting line and edits cutting data in response to detecting an input operation of selecting an edge of the medium image G13 or G14 included in the preview screen D13. The smartphone 1 changes an embroidery pattern and edits embroidery data in response to detecting an input operation of selecting the embroidery image in the medium image G13 or G14 included in the preview screen D13. In this way, the user can intuitively select an object to be changed or edited.

The smartphone 1 receives an operation for changing a print pattern with the first screen D2 (the first preview screen D21 or the first editing screen D22) being displayed. The smartphone 1 receives an operation for changing a cutting line with the second screen D3 (the second preview screen D31 or the second editing screen D32) being displayed. The smartphone 1 receives an operation for changing an embroidery pattern with the third screen D4 (the third preview screen D41 or the third editing screen D42 or D43) being displayed. The smartphone 1 edits processing data for a corresponding piece of the processing equipment in response to a change of a print pattern, a cutting line, or an embroidery pattern (S57, S87, S117). In this case, the user can perform an operation for editing the processing data in accordance with a change of the print pattern, the cutting line, or the embroidery pattern via a corresponding screen.

In response to a changed cutting line of which at least one of the position and the size has been changed being located within the processable range (S241: YES), the smartphone 1 sets the changed cutting line and edits the cutting data. When a cutting line changed by the input operation is located outside the processable range, the smartphone 1 can thus eliminate editing of the cutting data based on the changed cutting line.

In response to a changed embroidery pattern of which at least one of the position and the size has been changed being located within the processable range (S301: YES), the smartphone 1 sets the changed embroidery pattern and edits the embroidery data. When an operation of moving an embroidery pattern to the outside of the processable range is performed, the smartphone 1 can eliminates editing of the embroidery data based on the changed embroidery pattern.

When the changed cutting line does not overlap with the embroidery pattern (S243: NO), the smartphone 1 edits the cutting data based on the changed cutting line (S87). When the changed pattern does not overlap the cutting line (S311: YES), the smartphone 1 edits the changed pattern based on the changed pattern (S117). In this case, the smartphone 1 can reduce the possibility that a part of the embroidery pattern is not embroidered on each medium M1, M2 cut by the cutting machine 3.

The smartphone 1 edits obtained print data based on the first edit condition so as to enable the printer 2 to print a print pattern (S57). The smartphone 1 edits obtained cutting data based on the second edit condition so as to enable the cutting machine 3 to cut the medium M along the cutting line (S87). The smartphone 1 edits obtained embroidery data based on the third edit condition so as to enable the sewing machine 4 to sew an embroidery pattern (S117). The smartphone 1 can thus edit data to be processable at the processing equipment and output the edited data to the processing equipment.

The smartphone 1 obtains the smallest range among the identified first maximum range, second maximum range, and third maximum range as a maximum range, and obtains the largest range among the first minimum range, second minimum range, and third minimum range as a minimum range. The smartphone 1 further identifies a range larger than the minimum range and smaller than the maximum range as a processable range. Accordingly, the smartphone 1 can edit the processing data in a range in which the medium M can be processed by the processing equipment while maintaining the processing accuracy of the medium M by the processing equipment.

Modifications

The disclosure is not limited to the above-described embodiment, and various modifications can be made. The medium M to be processed by the processing equipment (including the printer 2, the cutting machine 3, and the sewing machine 4) in the system S is not limited to cloth. The processing equipment in the system S may process a known material to undergo printing, cutting, and sewing. The main process is not limited to being executed by the smartphone 1, and may be executed by a PC, a dedicated device, or other machine. Further, the main process may be executed by any one of the CPU 21 of the printer 2, the CPU 31 of the cutting machine 3, and the CPU 41 of the sewing machine 4.

At least one of the print data, the cutting data, and the embroidery data may be stored in a storage device of a server capable of communicating with the access point AP. The smartphone 1 may communicate with the server via the access point AP to transmit, to the server, request data including the type of processing data used for creating a work selected by the user and the type of processing equipment included in the system S. The server having received the request data may transmit, to the smartphone 1 via the access point AP, processing data that is used for creating a work of the type included in the request data and that can be processed by the type of processing equipment included in the request data. The smartphone 1 having detected an input operation for changing the print pattern, the cutting line, or the embroidery pattern may edit the processing data received from the server and transmit the edited processing data to the processing equipment via the access point AP.

The smartphone 1 should transmit the print data prior to the cutting data and the embroidery data, and the order of transmission of the cutting data and the embroidery data may be reversed. For example, after transmitting the print data to the printer 2, the smartphone 1 may simultaneously transmit the cutting data to the cutting machine 3 and the embroidery data to the sewing machine 4. In this case, the sewing machine 4 may store the embroidery data in the storage unit 42, and then wait until receiving an instruction from the user. The sewing machine 4 may sew the embroidery pattern after receiving an instruction from the user.

The smartphone 1 may simultaneously transmit the print data, the cutting data, and the embroidery data. In this case, the printer 2 may receive and store the print data in the storage unit 22, and then wait until receiving an instruction from the user. The printer 2 may print a print pattern after receiving an instruction from the user. The cutting machine 3 may receive and store the embroidery data in the storage unit 32, and then wait until receiving an instruction from the user. The cutting machine 3 may cut the medium M along the cutting line after receiving an instruction from the user. The sewing machine 4 may receive and store the embroidery data in the storage unit 42, and then wait until receiving an instruction from the user. The sewing machine 4 may sew the embroidery pattern after receiving an instruction from the user.

The smartphone 1 having detected an input operation with the preview screen D13 being displayed may change the print pattern, cutting line, or embroidery pattern on the preview screen D13 in response to the input operation without switching to the first screen D2, the second screen D3, or the third screen D4. In this case, any of the print pattern, the cutting line, and the embroidery pattern included in each of the medium images G13 and G14 may be switched to the changed one in response to the change in the print pattern, the cutting line, or the embroidery pattern.

The smartphone 1 may control the display 13 to display a notification screen for providing notification to the user in response to in response to not detecting an input operation within the first predetermined time after the first reception screen D51 was displayed on the display 13 (S63: YES) or within the second predetermined time after the second reception screen D52 was displayed on the display 13 (S93: YES). The smartphone 1 may control the display 13 to continue to display the first reception screen D51 in response to not detecting an input operation within the first predetermined time after the first reception screen D51 was displayed on the display 13 (S63: YES). The smartphone 1 may control the display 13 to continue to display the second reception screen D52 in response to not detecting an input operation within the second predetermined time after the second reception screen D52 was displayed on the display 13 (S93: YES).

The smartphone 1 may control the display 13 to display a notification message (S97) in response only to detecting an input operation of switching the second reception screen D52 to the third reception screen D53 before transmission of the cutting data to the cutting machine 3 (S91: YES, S95: NO), regardless of whether the print data has been transmitted to the printer 2. The smartphone 1 may not perform notification in accordance with the operations of S67, S97, and S125.

The preview screen D13 may have buttons indicating "Print", "Cut", and "Embroider". The smartphone 1 having detected an input operation of selecting "Print" may change a print pattern and edit print data. The smartphone 1 having detected an input operation of selecting "Cut" may change a cutting line and edit cutting data. The smartphone 1 having detected an input operation of selecting "Embroider" may change an embroidery pattern and edit embroidery data.

The smartphone 1 having detected an input operation with the first preview screen D21 being displayed may change the print pattern on the first preview screen D21 in response to the input operation without switching to the first editing screen D22. The smartphone 1 having detected an input operation with the second preview screen D31 being displayed may change the cutting line on the second preview screen D31 in response to the input operation without switching to the second editing screen D32. The smartphone 1 having detected an input operation with the third preview screen D41 being displayed may change the embroidery pattern on the third preview screen D41 in response to the input operation without switching to the third editing screen D42, D43.

The smartphone 1 may allow changing of a print pattern and edit print data when the print pattern changed in response to the input operation is located within a first processable range that is a range larger than the first minimum range and smaller than the first maximum range. The smartphone 1 may allow changing of a cutting line and edit cutting data when the cutting line changed in response to the input operation is located within a second processable range that is a range larger than the second minimum range and smaller than the second maximum range. The smartphone 1 may allow changing of an embroidery pattern and edit embroidery data when the embroidery pattern changed in response to the input operation is located within a third processable range that is a range larger than the third minimum range and smaller than the third maximum range. The smartphone 1 may allow changing of the print pattern, the cutting line, and the embroidery pattern and edit processing data, regardless of the positional relationship between the print pattern, the cutting line, and the embroidery pattern relative to the processable range and the first to third processable ranges.

The smartphone 1 may always allow changing of the cutting line and edit the cutting data regardless of the positional relationship between the cutting line and the embroidery pattern. The smartphone 1 may always allow changing of the embroidery pattern and edit the embroidery data regardless of the positional relationship between the cutting line and the embroidery pattern.

The smartphone 1 may obtain the first to third edit conditions through communications with the printer 2, the cutting machine 3, and the sewing machine 4 disposed in the system S. The smartphone 1 may determine whether the changed print pattern can be printed by the printer 2 based on the first edit condition. In response to determining that printing is possible, the smartphone 1 may edit the print data and transmit the print data to the printer 2. In contrast, in response to determining that printing is impossible, the smartphone 1 may display a notification screen for providing notification to the user on the display 13 and abort the edit of the print data. The smartphone 1 may determine whether the cutting machine 3 can cut along the changed cutting line based on the second edit condition. In response to determining that cutting is possible, the smartphone 1 may edit the cutting data and transmit the cutting data to the cutting machine 3. In contrast, in response to determining that cutting is impossible, the smartphone 1 may display a notification screen for providing notification to the user on the display 13 and abort the edit of the cutting data. The smartphone 1 may determine whether the changed embroidery pattern can be sewn by the sewing machine 3 based on the third edit condition. In response to determining that sewing is possible, the smartphone 1 may edit the embroidery data and transmit the embroidery data to the sewing machine 4. In contrast, in response to determining that sewing is impossible, the smartphone 1 may display a notification screen for providing notification to the user on the display 13 and abort the edit of the embroidery data.

Others

The operations of S23, S201, S231, and S271 are each an example of an operation of displaying an editing screen or a preview screen on a display of the disclosure. The operations of S25, S29, S33, S203, S233, S273, and S301 are each an example of an operation of receiving an operation for editing the data of the disclosure. The operations of S57, S87, S117 are each an example of an operation of editing data of the disclosure. The operations of S59, S89, S119 are each an example of an operation of outputting data of the disclosure. The operation of S59 is an example of an operation of outputting print data to a printer of the disclosure. The operation of S89 is an example of an operation of outputting cutting data to a cutting machine of the disclosure. The operation of S119 is an example of an operation of outputting embroidery data to a sewing machine of the disclosure. The operations of S51, S81, and S111 are each an example of displaying a reception screen on a display of the disclosure. The operation of S11 is an example of an operation of obtaining setting information and an example of an operation of obtaining a maximum range and a minimum range of the disclosure.

What is claimed is:

1. A data processing method for processing print data for a printer, cutting data for a cutting machine, and embroidery data for a sewing machine, the data processing method comprising:

displaying sample images indicating works to be created by the printer, the cutting machine, and the sewing machine;

selecting one of the works as a selected work, based on the sample images displayed;

determining the print data, the cutting data, and the embroidery data to be used for creating the selected work;

outputting the print data to the printer from a computer in response to a first instruction to output the print data, and after outputting the print data:

outputting the embroidery data to the sewing machine from the computer in response to outputting the cutting data to the cutting machine from the computer; or outputting the cutting data to the cutting machine from the computer in response to outputting the embroidery data to the sewing machine from the computer.

2. The data processing method according to claim 1, wherein after outputting the print data, the cutting data is output to the cutting machine, and after outputting the cutting data, the embroidery data is output to the sewing machine.

3. The data processing method according to claim 1, wherein after outputting the print data, the cutting data is output to the cutting machine in response to a second instruction to output the cutting data.

4. The data processing method according to claim 3, wherein after outputting the cutting data, the embroidery data is output to the sewing machine in response to a third instruction to output the embroidery data.

5. The data processing method according to claim 3, further comprising:

displaying a first reception screen for receiving the first instruction; and after displaying the first reception screen, displaying a second reception screen for receiving the second instruction, wherein, after displaying the first reception screen and before displaying the second reception screen, the print data is output to the printer in response to the first instruction received via the first reception screen, and wherein after outputting the print data and after displaying the second reception screen, the cutting data is output to the cutting machine in response to the second instruction received via the second reception screen.

6. The data processing method according to claim 5, further comprising:

displaying a third reception screen for receiving the third instruction, wherein after outputting the cutting data, the embroidery data is output to the sewing machine in response to the third instruction received via the third reception screen.

7. The data processing method according to claim 3, further comprising:

displaying a first reception screen for receiving the first instruction; and after displaying the first reception screen, displaying a second reception screen for receiving the second instruction, wherein the print data is output to the printer in response to the first instruction received via the first reception screen, and wherein the cutting data is output to the cutting machine in response to the second instruction received via the second reception screen.

8. The data processing method according to claim 1, wherein after outputting the print data, the embroidery data is output to the sewing machine in response to a third instruction to output the embroidery data.

9. The data processing method according to claim 8, wherein after outputting the embroidery data, the cutting data is output to the cutting machine in response to a second instruction to output the cutting data.

10. The data processing method according to claim 8, further comprising:

displaying a first reception screen for receiving the first instruction; and after displaying the first reception screen, displaying a third reception screen for receiving the third instruction, wherein, after displaying the first reception screen and before displaying the third reception screen, the print data is output to the printer in response to the first instruction received via the first reception screen, and wherein after outputting the print data and after displaying the third reception screen, the embroidery data is output to the sewing machine in response to the third instruction received via the third reception screen.

11. The data processing method according to claim 10, further comprising:

displaying a second reception screen for receiving the second instruction, wherein after outputting the embroidery data, the cutting data is output to the cutting machine in response to the second instruction received via the second reception screen.

12. The data processing method according to claim 8, further comprising:

displaying a first reception screen for receiving the first instruction; and after displaying the first reception screen, displaying a third reception screen for receiving the third instruction, wherein the print data is output to the printer in response to the first instruction received via the first reception screen, and wherein the embroidery data is output to the sewing machine in response to the third instruction received via the third reception screen.

13. The data processing method according to claim 1, wherein the sample images indicate works created on a medium through steps of printing based on the print data using the printer, cutting based on the cutting data using the cutting machine, and sewing based on the embroidery data using the sewing machine.

14. A data processing method for processing print data for a printer, cutting data for a cutting machine, and embroidery data for a sewing machine, the data processing method comprising:

displaying sample images indicating works to be created by the printer, the cutting machine, and the sewing machine;

selecting one of the works as a selected work, based on the sample images displayed, wherein the selected work is associated with print data, cutting data, and embroidery data;

outputting the print data to be used for creating the selected work to the printer;

outputting the accessed cutting data to be used for creating the selected work to the cutting machine;

outputting the embroidery data to be used for creating the selected work to the sewing machine; and printing on a medium based on the output print data in response to a print instruction received by the printer, after printing:

cutting the medium based on the output cutting data in response to a cutting instruction received by the cutting machine, and after cutting, stitching on the medium based on the embroidery data in response to a sewing instruction received by the sewing machine; or stitching on the medium based on the output embroidery data in response to the embroidery instruction received by the sewing machine, and after stitching, cutting the medium based on the cutting data in response to the cutting instruction received by the cutting machine.

15. The data processing method according to claim 14, wherein after printing, cutting the medium based on the output cutting data in response to the cutting instruction received by the cutting machine, and after cutting, stitching on the medium based on the output embroidery data in response to the sewing instruction received by the sewing machine.

16. The data processing method according to claim 14, wherein the sample images indicate works created on the medium through steps of printing based on the print data using the printer, cutting based on the cutting data using the cutting machine, and sewing based on the embroidery data using the sewing machine.

* * * * *